US006116158A

United States Patent [19]

DeMoore et al.

[11] Patent Number: 6,116,158

[45] **Date of Patent: *Sep. 12, 2000**

[54] RETRACTABLE PRINTING/COATING UNIT OPERABLE ON THE PLATE AND BLANKET CYLINDERS

[75] Inventors: Howard W. DeMoore, 10954 Shady Trail, Dallas, Tex. 75220; Ronald M. Rendleman, Dallas, Tex.; John W. Bird, Carrollton, Tex.

[73] Assignee: Howard W. DeMoore, Dallas, Tex.

[ * ] Notice: This patent issued on a continued prosecution application filed under 37 CFR 1.53(d), and is subject to the twenty year patent term provisions of 35 U.S.C. 154(a)(2).

[21] Appl. No.: 08/538,021

[22] Filed: Oct. 2, 1995

Related U.S. Application Data

[63] Continuation-in-part of application No. 08/435,798, May 4, 1995.

[51] Int. Cl.[7] ..... B41F 5/06; B41F 5/22

[52] U.S. Cl. ..... 101/177; 101/352.01

[58] Field of Search ..... 101/349, 350–352, 101/207–210, 363, 364, 147, 148, 143, 144, 217, 218, 177, 247; 118/258–262, 263, 46, 349.1, 350.1, 352.01, 352.02, 352.04, 352.05, 352.09

[56] References Cited

U.S. PATENT DOCUMENTS

| | | | |
|---|---|---|---|
| 3,397,675 | 8/1968 | De Ligt | 118/258 |
| 3,433,155 | 3/1969 | Norton | 101/148 |
| 3,768,438 | 10/1973 | Kumpf | 118/262 |
| 3,800,743 | 4/1974 | Egnaczak | 118/259 |
| 3,916,824 | 11/1975 | Knodel et al. | 118/224 |
| 3,931,791 | 1/1976 | Preuss et al. | 118/236 |
| 4,165,688 | 8/1979 | Leanna et al. | 101/207 |
| 4,222,325 | 9/1980 | Edwards | 101/137 |
| 4,270,483 | 6/1981 | Butler et al. | 118/46 |
| 4,372,244 | 2/1983 | Rebel | 118/46 |
| 4,397,237 | 8/1983 | Makosch | 101/352 |
| 4,399,767 | 8/1983 | Simeth | 118/46 |
| 4,421,027 | 12/1983 | Fischer | 101/142 |
| 4,446,814 | 5/1984 | Abendroth | 118/694 |
| 4,501,223 | 2/1985 | Matsuno et al. | 118/668 |
| 4,524,712 | 6/1985 | Ito | 118/46 |
| 4,569,306 | 2/1986 | Ito et al. | 118/249 |
| 4,615,293 | 10/1986 | Jahn | 118/46 |
| 4,685,414 | 8/1987 | DiRico | 101/352 |
| 4,706,601 | 11/1987 | Jahn | 118/46 |
| 4,779,557 | 10/1988 | Frazzitta | 118/46 |
| 4,796,556 | 1/1989 | Bird | 118/46 |
| 4,815,413 | 3/1989 | Kota | 118/46 |
| 4,825,804 | 5/1989 | Kirico et al. | 118/46 |
| 4,841,903 | 6/1989 | Bird | 101/201 X |

(List continued on next page.)

*Primary Examiner*—J. Reed Fisher
*Attorney, Agent, or Firm*—Locke Liddell & Sapp LLP

[57] ABSTRACT

A retractable in-line inking/coating apparatus can apply either spot or overall inking/coating material to a plate and/or a blanket on the first printing unit or on any consecutive printing unit of any rotary offset printing press. The inking/coating apparatus is pivotally mounted within the conventional dampener space of any lithographic printing unit. The aqueous component of the flexographic printing ink or aqueous coating material is evaporated and dried by high velocity, hot air dryers and high performance heat and moisture extractors so that the aqueous or flexographic ink or coating material on a freshly printed or coated sheet is dry and can be dry-trapped on the next printing unit. The inking/coating apparatus includes dual cradles that support first and second applicator rollers so that the inking/coating apparatus can apply a double bump of aqueous/flexographic or UV-curable printing ink or coating material to a plate on the plate cylinder, while simultaneously applying aqueous, flexographic or UV-curable printing ink or coating material to a plate or a blanket on the blanket cylinder, and thereafter onto a sheet as the sheet is transferred through the nip between the blanket cylinder and the impression cylinder. A triple bump is printed or coated on the last printing unit with the aid of an impression cylinder inking/coating unit.

50 Claims, 15 Drawing Sheets

U.S. PATENT DOCUMENTS

| | | | |
|---|---|---|---|
| 4,852,515 | 8/1989 | Terasaka et al. | 118/663 |
| 4,889,051 | 12/1989 | Sarda | 101/77 |
| 4,934,305 | 6/1990 | Koehler | 101/329 |
| 5,107,790 | 4/1992 | Sliker et al. | 118/674 |
| 5,115,741 | 5/1992 | Rodi | 101/416.1 X |
| 5,176,077 | 1/1993 | DeMoore et al. | 101/232 |
| 5,178,678 | 1/1993 | Koehler et al. | 118/46 |
| 5,209,179 | 5/1993 | Herbert et al. | 118/46 |
| 5,280,750 | 1/1994 | Yoshida et al. | 101/363 |
| 5,598,777 | 2/1997 | DeMoore et al. . | |
| 5,630,363 | 5/1997 | Davis et al. . | |
| 5,651,316 | 7/1997 | DeMoore et al. . | |

RETRACTABLE PRINTING/COATING UNIT OPERABLE ON THE PLATE AND BLANKET CYLINDERS

CROSS REFERENCE TO RELATED APPLICATION

This application is a continuation-in-part of copending application Ser. No. 08/435,798 filed May 4, 1995 entitled "Retractable Inking/Coating Apparatus Having Ferris Movement Between Printing Units."

FIELD OF THE INVENTION

This invention relates generally to sheet-fed or web-fed, rotary offset lithographic printing presses, and more particularly, to a new and improved inking/coating apparatus for the in-line application of aqueous or flexographic printing inks, primer or protective/decorative coatings applied simultaneously to the plate and blanket of the first or any consecutive printing unit of any lithographic printing press.

BACKGROUND OF THE INVENTION

Conventional sheet-fed, rotary offset printing presses typically include one or more printing units through which individual sheets are fed and printed. After the last printing unit, freshly printed sheets are transferred by a delivery conveyor to the delivery end of the press where the freshly printed and/or coated sheets are collected and stacked uniformly. In a typical sheet-fed, rotary offset printing press such as the Heidelberg Speedmaster line of presses, the delivery conveyor includes a pair of endless chains carrying gripper bars with gripper fingers which grip and pull freshly printed sheets from the last impression cylinder and convey the sheets to the sheet delivery stacker.

Since the inks used with sheet fed rotary offset printing presses are typically wet and tacky, special precautions must be taken to prevent marking and smearing of the freshly printed or coated sheets as the sheets are transferred from one printing unit to another. The printed ink on the surface of the sheet dries relatively slowly and is easily smeared during subsequent transfer between printing units. Marking, smearing and smudging can be prevented by a vacuum assisted sheet transfer apparatus as described in the following U.S. Pat. Nos. 5,113,255; 5,127,329; 5,205,217; 5,228,391; 5,243,909; and 5,419,254, all to Howard W. DeMoore, co-inventor, and manufactured and sold by Printing Research, Inc. of Dallas, Tex., U.S.A. under its trademark BACVAC™.

In some printing jobs, offsetting is prevented by applying a protective and/or decorative coating material over all or a portion of the freshly printed sheets. Some coatings are formed of a UV-curable or water-dispersed resin applied as a liquid solution over the freshly printed sheets to protect the ink from offsetting or set-off and improve the appearance of the freshly printed sheets. Such coatings are particularly desirable when decorative or protective finishes are applied in the printing of posters, record jackets, brochures, magazines, folding cartons and the like.

DESCRIPTION OF THE PRIOR ART

Various arrangements have been made for applying the coating as an in-line printing operation by using the last printing unit of the press as the coating application unit. For example, U.S. Pat. Nos. 4,270,483; 4,685,414; and 4,779,557 disclose coating apparatus which can be moved into position to permit the blanket cylinder of the last printing unit of a printing press to be used to apply a coating material over the freshly printed sheets. In U.S. Pat. No. 4,841,903 (Bird) there are disclosed coating apparatus which can be selectively moved between the plate cylinder or the blanket cylinder of the last printing unit of the press so the last printing unit can only be used for coating purposes. However, when coating apparatus of these types are being used, the last printing unit cannot be used to print ink to the sheets, but rather can only be used for the coating operation. Thus, while coating with this type of in-line coating apparatus, the printing press loses the capability of printing on the last printing unit as it is converted to a coating unit.

The coater of U.S. Pat. No. 5,107,790 (Sliker et al) is retractable along an inclined rail for extending and retracting a coater head into engagement with a blanket on the blanket cylinder. Because of its size, the rail-retractable coater can only be installed between the last printing unit of the press and the de livery sheet stacker, and cannot be used for interunit coating. The coater of U.S. Pat. No. 4,615,293 (Jahn) provides two separate, independent coaters located on the dampener side of a converted printing unit for applying lacquer to a plate and to a rubber blanket. Consequently, although a plate and blanket are provided, the coating unit of Jahn's press is restricted to a dedicated coating operation only.

Proposals have been made for overcoming the loss of a printing unit when in-line coating is used, for example as set forth in U.S. Pat. No. 5,176,077 to Howard W. DeMoore (co-inventor and assignee), which discloses a coating apparatus having an applicator roller positioned to apply the coating material to the freshly printed sheet while the sheet is still on the last impression cylinder of the press. This allows the last printing unit to print and coat simultaneously, so that no loss of printing unit capability results.

Some conventional coaters are rail-mounted and occupy a large amount of press space and reduce access to the press. Elaborate equipment is needed for retracting such coaters from the operative coating position to the inoperative position, which reduces access to the printing unit.

Accordingly, there is a need for an in-line inking/coating apparatus which does not result in the loss of a printing unit, does not extend the length of the press, and which can print and coat aqueous and flexographic inks and coating materials simultaneously onto the plate and blanket on any lithographic printing unit of any lithographic printing press, including the first printing unit.

OBJECTS OF THE INVENTION

Accordingly, a general object of the present invention is to provide improved inking/coating apparatus which is capable of selectively applying ink or coating material to a plate on a plate cylinder or ink or coating material to a plate or blanket on a blanket cylinder.

A specific object of the present invention is to provide improved inking/coating apparatus of the character described which is extendable into inking/coating engagement with either a plate on a plate cylinder or to a plate or blanket on a blanket cylinder.

A related object of the present invention is to provide improved inking/coating apparatus of the character described which is capable of being mounted on any lithographic printing unit of the press and does not interfere with operator access to the plate cylinder, blanket cylinder, or adjacent printing units.

Another object of the present invention is to provides improved inking/coating apparatus of the character described, which can be moved from an operative inking/coating engagement position adjacent to a plate cylinder or a blanket cylinder to a non-operative, retracted position.

Still another object of the present invention is to provide improved inking/coating apparatus of the character described, which can be used for applying aqueous, flexographic and ultra-violet curable inks and/or coatings in combination with lithographic, flexographic and waterless printing processes on any rotary offset printing press.

A related object of the present invention is to provide improved inking/coating apparatus of the character described, which is capable of applying aqueous or flexographic ink or coating material on one printing unit, for example the first printing unit, and drying the ink or coating material before it is printed or coated on the next printing unit so that it can be overprinted or overcoated immediately on the next printing unit with waterless, aqueous, flexographic or lithographic inks or coating materials.

Yet another object of the present invention is to provide improved inking/coating apparatus for use on a multiple color rotary offset printing press that can apply ink or coatings material separately and/or simultaneously to the plate and/or blanket of a printing unit of the press from a single operative position, and from a single inking/coating apparatus.

A related object of the present invention is to provide improved inking/coating apparatus of the character described, in which virtually no printing unit adjustment or alteration is required when the inking/coating apparatus is converted from plate to blanket printing or coating and vice versa.

Another object of the present invention is to provide improved inking/coating apparatus that can be operably mounted in the dampener space of any lithographic printing unit for inking/coating engagement with either a plate on a plate cylinder or a plate or blanket on a blanket cylinder, and which does not interfere with operator movement or activities in the interunit space between printing units.

SUMMARY OF THE INVENTION

The foregoing objects are achieved by a retractable, in-line inking/coating apparatus which is mounted on the dampener side of any printing unit of a rotary offset press for movement between an operative (on-impression) inking/coating position and a retracted, disengaged (off-impression) position. The inking/coating apparatus includes an applicator roller which is movable into and out of engagement with a plate on a plate cylinder or a blanket on a blanket cylinder. The inking/coating applicator head is pivotally coupled to a printing unit by pivot pins which are mounted on the press side frames in the traditional dampener space of the printing unit in parallel alignment with the plate cylinder and the blanket cylinder. This dampener space mounting arrangement allows the inking/coating unit to be installed between any adjacent printing units on the press.

In the preferred embodiment, the applicator head includes vertically spaced pairs of cradle members with one cradle pair being adapted for supporting an inking/coating applicator roller in alignment with a plate cylinder, and the other cradle pair supporting an inking/coating applicator roller in alignment with the blanket cylinder, respectively, when the applicator head is in the operative position. Because of the pivotal support provided by the pivot pins, the applicator head can be extended and retracted within the limited space available in the traditional dampener space, without restricting operator access to the printing unit cylinders and without causing a printing unit to lose its printing capability.

When the inking/coating apparatus is used in combination with a flexographic printing plate and aqueous or flexographic ink or coating material, the water component of the aqueous or flexographic ink or coating material on the freshly printed or coated sheet is evaporated and dried by a high velocity, hot air interunit dryer and a high volume heat and moisture extractor assembly so that the freshly printed ink or coating material is dry before the sheet is printed or coated on the next printing unit. This quick drying process permits a base layer or film of ink, for example opaque white or metallic (gold, silver or other metallics) ink to be printed on the first printing unit, and then overprinted on the next printing unit without back-trapping or dot gain.

The construction and operation of the present invention will be understood from the following detailed description taken in conjunction with the accompanying drawings which disclose, by way of example, the principles and advantages of the present invention.

DETAILED DESCRIPTION OF THE PREFERRED EMBODIMENTS

As used herein, the term "processed" refers to printing and coating methods which can be applied to either side of a substrate, including the application of lithographic, waterless, UV-curable, aqueous and flexographic inks and/or coatings. The term "substrate" refers to sheet and web material. Also, as used herein, the term "waterless printing plate" refers to a printing plate having image areas and non-image areas which are oleophilic and oleophobic, respectively. "Waterless printing ink" refers to, an oil-based ink which does not contain a significant aqueous component. "Flexographic plate" refers to a flexible printing plate having a relief surface which is wettable by flexographic ink or coating material. "Flexographic printing ink or coating material" refers to an ink or coating material having a base constituent of either water, solvent or UV-curable liquid. "UV-curable lithographic printing ink and coating material" refers to oil-based printing inks and coating materials that can be cured (dried) photomechanically by exposure to ultraviolet radiation, and that have a semi-paste or gel-like consistency. "Aqueous printing ink or coating material" refers to an ink or coating material that predominantly contains water as a solvent, diluent or vehicle. A "relief plate" refers to a printing plate having image areas which are raised relative to non-image areas which are recessed.

Figure 1:
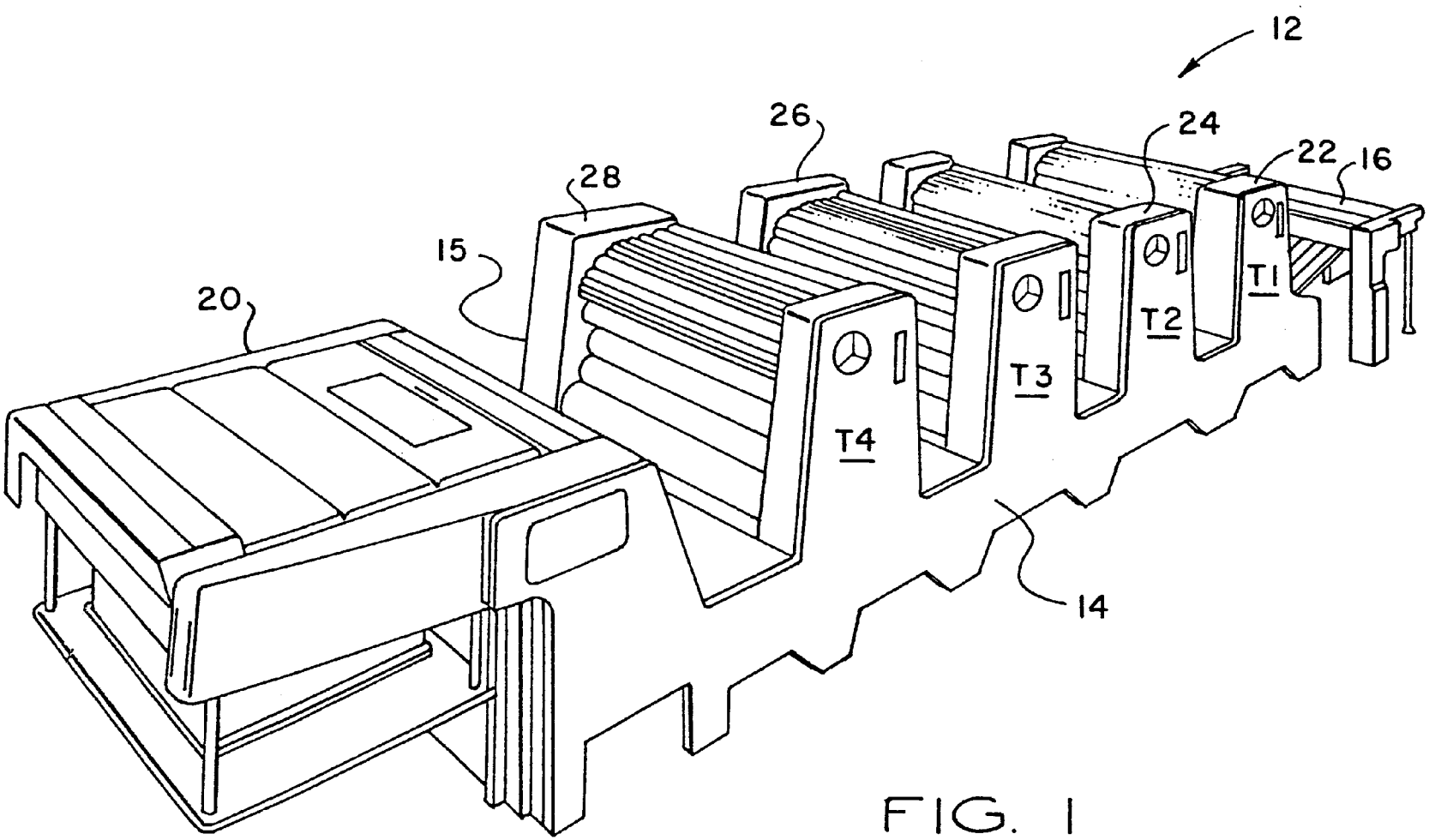
FIG. 1 is a perspective view of a sheet fed, rotary offset printing press having inking/coating apparatus embodying the present invention.

As shown in the exemplary drawings, the present invention is embodied in a new and improved in-line inking/coating apparatus, herein generally designated 10, for applying aqueous, flexographic or UV-curable inks or protective and/or decorative coatings to sheets or webs printed in a sheet-fed or web-fed, rotary offset printing press, herein generally designated 12. In this instance, as shown in FIG. 1, the inking/coating apparatus 10 is installed in a four unit rotary offset printing press 12, such as that manufactured by Heidelberger Druckmaschinen AG of Germany under its designation Heidelberg Speedmaster SM102 (40", 102 cm).

The press 12 includes a press frame 14 coupled at one end, herein the right end, to a sheet feeder 16 from which sheets, herein designated S, are individually and sequentially fed into the press, and at the opposite end, with a sheet delivery stacker 20 in which the freshly printed sheets are collected and stacked. Interposed between the sheet feeder 16 and the sheet delivery stacker 20 are four substantially identical sheet printing units 22, 24, 26 and 28 which can print four different colors onto the sheets as they are transferred through the press 12. The printing units are housed within printing towers T1, T2, T3 and T4 formed by side frame members 14, 15. Each printing tower has a delivery side 25 and a dampener side 27. A dampener space 29 is partially enclosed by the side frames on the dampener side of the printing unit.

As illustrated, the printing units 22, 24, 26 and 28 are substantially identical and of conventional design. The first printing unit 22 includes an in-feed transfer cylinder 30, a plate cylinder 32, a blanket cylinder 34 and an impression cylinder 36, all supported for rotation in parallel alignment between the press side frames 14, 15 which define printing unit towers T1, T2, T3 28 and T4. Each of the first three printing units 22, 24 and 26 have 29 a transfer cylinder 38 disposed to transfer the freshly printer sheets from the adjacent impression cylinder and transfer the, freshly printed sheets to the next printing unit via an intermediate transfer drum 40.

The last printing unit 28 includes a delivery cylinder 42 mounted on a delivery shaft 43. The delivery cylinder 42 supports the freshly printed sheet 18 as it is transferred from the last impression cylinder 36 to a delivery conveyor system, generally designated 44, which transfers the freshly printed sheet to the sheet delivery stacker 20. To prevent smearing during transfer, a flexible covering is mounted on the delivery cylinder 42, as described and claimed in U.S. Pat. No. 4,402,267 to Howard W. DeMoore, which is incorporated herein by reference. The flexible covering is manufactured and sold by Printing Research, Inc. of Dallas, Tex., U.S.A., under its trademark SUPER BLUE®. Optionally, a vacuum-assisted sheet transfer assembly manufactured and sold by Printing Research, Inc. of Dallas, Tex., U.S.A., under its trademark BACVAC® can be substituted for the delivery transfer cylinder 42 and flexible covering.

Figure 2:
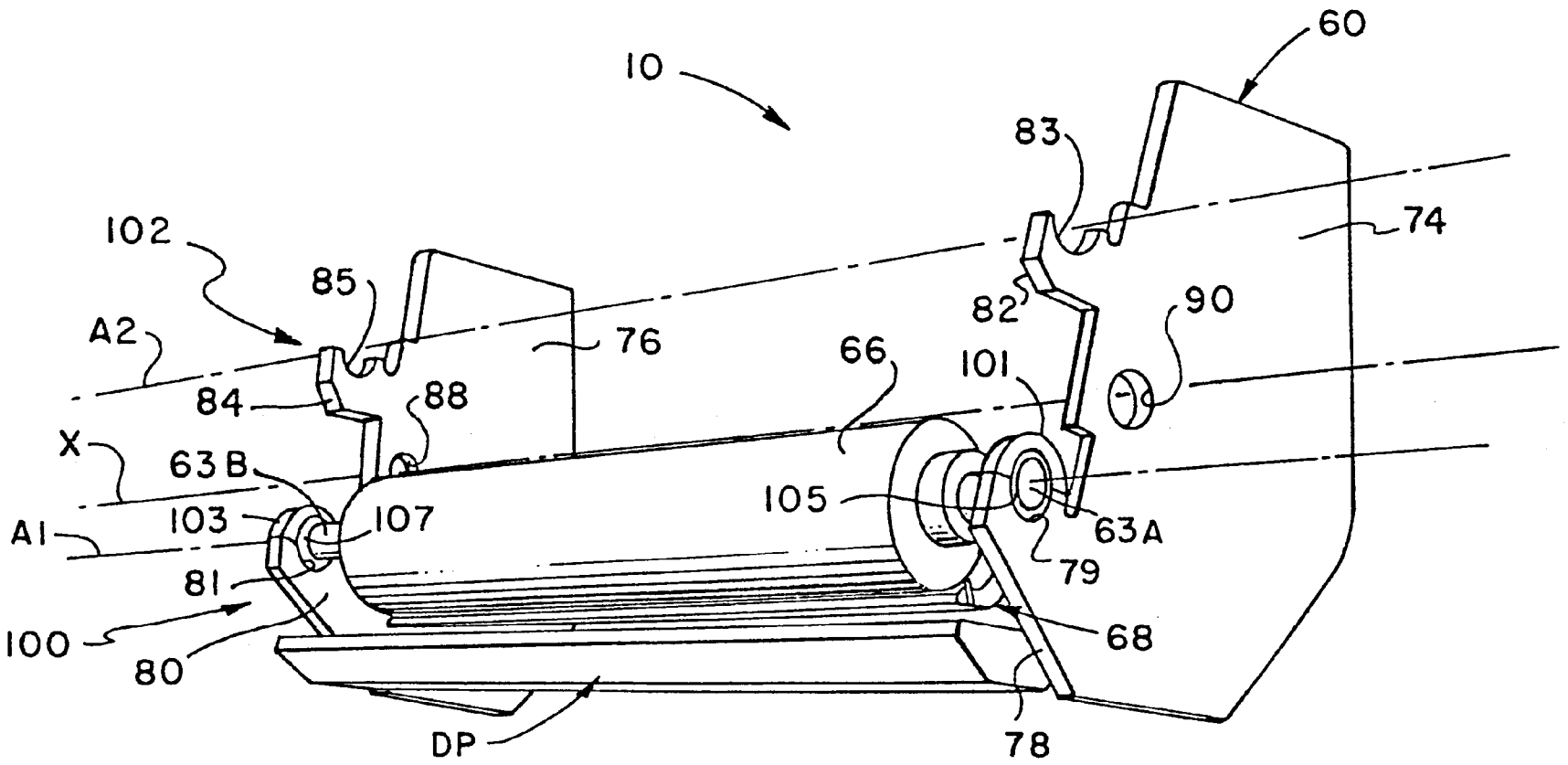
FIG. 2 is a simplified perspective view of the single head, dual cradle inking/coating apparatus of the present invention.

The delivery conveyor system 44 as shown in FIG. 2 is of conventional design and includes a pair of endless delivery gripper chains 46, only one of which is shown carrying at regular spaced locations along the chains, laterally disposed gripper bars, having gripper fingers used to grip the leading edge of a freshly printed or coated sheet 18 after it leaves the nip between the impression cylinder 36 and delivery cylinder 42 of the last printing unit 28. As the leading edge is gripped by the gripper fingers, the delivery chains 46 pull the sheet away from the last impression cylinder 36 and convey the freshly printed or coated sheet to the sheet delivery stacker 20.

Prior to reaching the delivery sheet stacker, the freshly printed and/or coated sheets S pass under a delivery dryer 48 which includes a combination of infra-red thermal radiation, high velocity hot air flow and a high performance heat and moisture extractor for drying the ink and/or the protective/decorative coating. Preferably, the delivery dryer 48, including the high performance heat and moisture extractor is; constructed as described in U.S. application Ser. No. 08/116,711, filed Sep. 3, 1993, entitled "Infra-Red Forced Air Dryer and Extractor" by Howard C. Secor, Ronald M. Rendleman and Paul D. Copenhaver, commonly assigned to the assignee of the present invention, Howard W. DeMoore, and licensed to Printing Research, Inc. of Dallas, Tex., U.S.A., which manufactures and markets the delivery dryer 48 under its trademark AIR BLANKET™.

Figure 3:
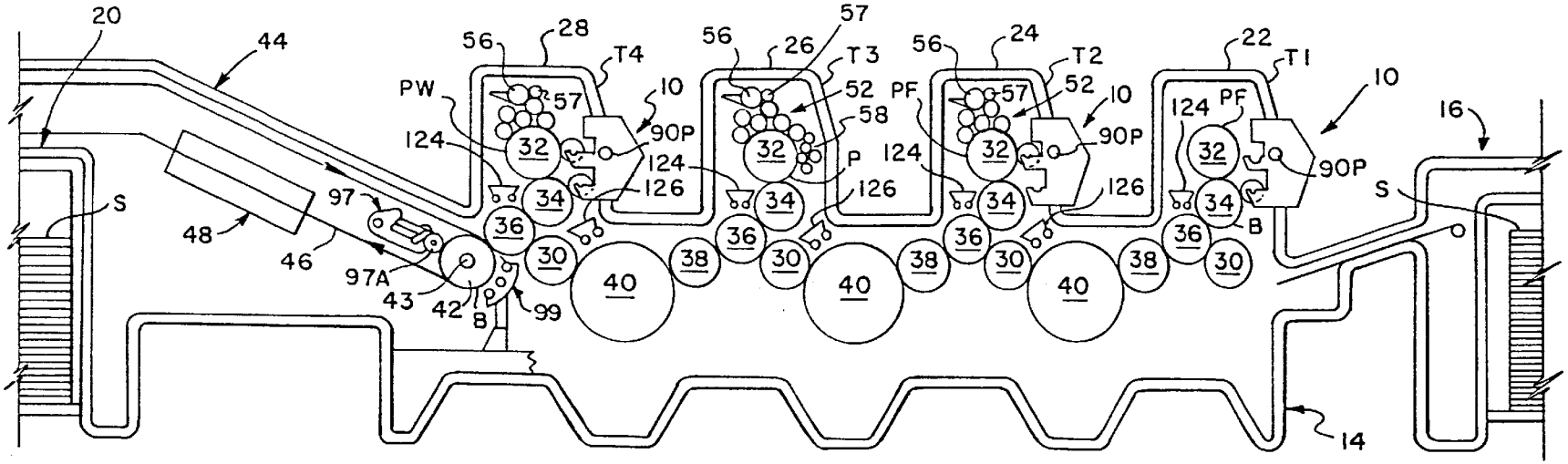
FIG. 3 is a schematic side elevational view of the printing press of FIG. 1 having single head, dual cradle inking/coating apparatus installed in the traditional dampener position of the first, second and last printing units.

In the exemplary embodiment shown in FIG. 3, the first printing unit 22 has a flexographic printing plate PF mounted in the plate cylinder, and therefore neither an inking roller train nor a dampening system is required. A flexographic printing plate PF is also mounted on the plate cylinder of the second printing a unit 24. The form rollers of the inking roller train 52 shown mounted on the second printing unit 24 are retracted and locked off to prevent plate contact. Flexographic ink is supplied to the flexographic plate PF of the second printing unit 24 by the inking/coating apparatus 10.

A suitable flexographic printing plate PF is offered by E. I. du Pont de Nemours of Wilmington, Del., U.S.A., under its trademark CYREL®. Another source is BASF Aktiengesellschaft of Ludwigshafen, Germany, which offers a suitable flexographic printing plate under its trademark NYLOFLEX®.

Figure 4:
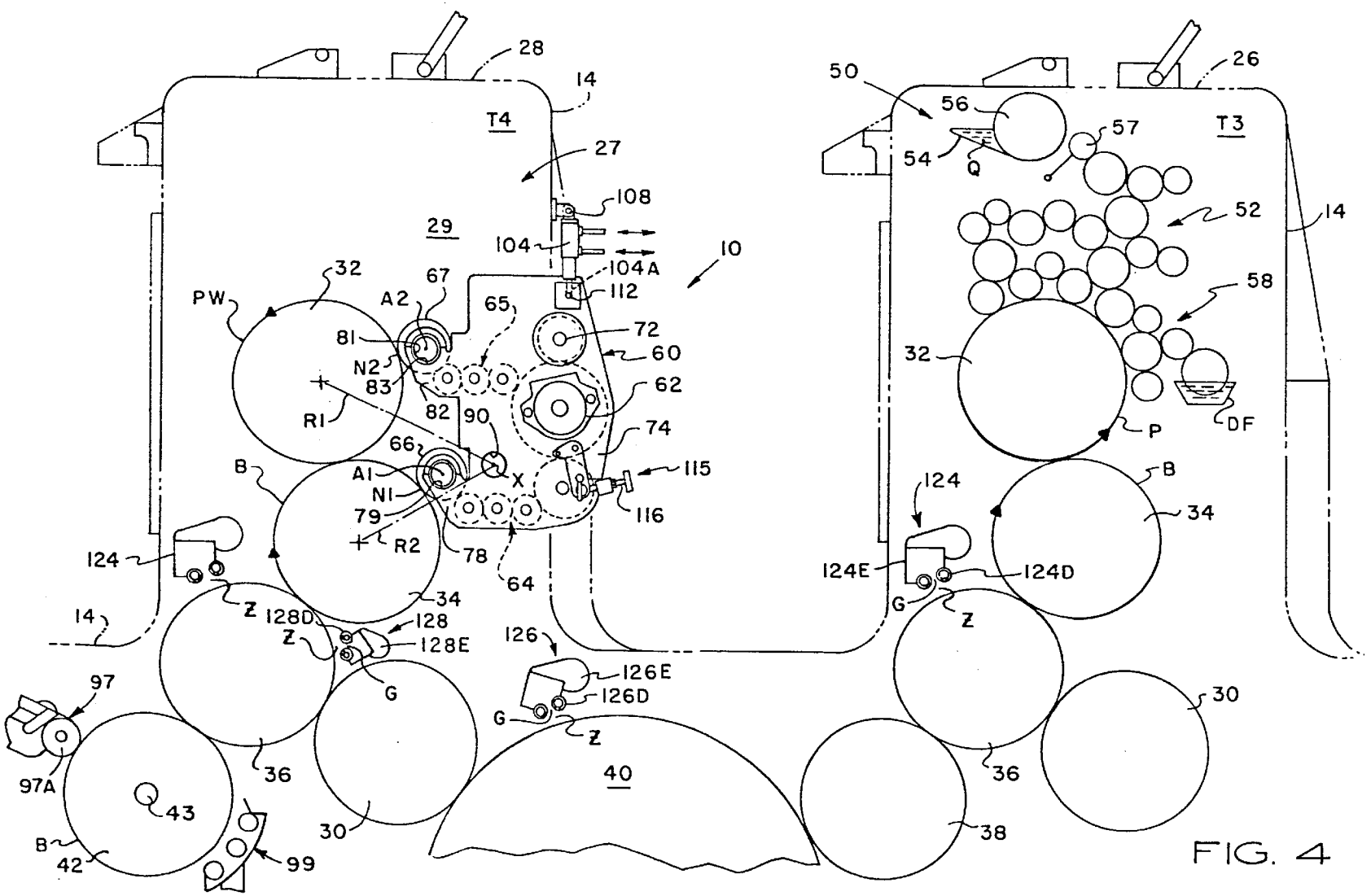
FIG. 4 is a simplified side elevational view showing the single head, dual cradle inking/coating apparatus in the operative inking/coating position for simultaneously printing on the printing plate and blanket on the fourth printing unit.

The third printing unit 26 as illustrated in FIG. 3 and FIG. 4 is equipped for lithographic printing and includes all inking apparatus 50 having an inking roller train 52 arranged to transfer ink Q from an ink fountain 54 to a lithographic plate P mounted on the plate cylinder 32. This is accomplished by a fountain roller 56 and a ductor roller 57. The fountain roller 56 projects into the ink fountain 54, whereupon its surface picks up) ink. The lithographic printing ink Q is transferred from thee fountain roller 56 to the inking roller train 52 by the ductor roller 57. The inking roller train 52 supplies ink Q to the image areas of the lithographic printing plate P.

The lithographic printing ink Q is transferred from the lithographic printing plate P to an ink receptive blanket B which is mounted on the blanket cylinder 34. The inked image carried on the blanket B is transferred to a substrate S as the substrate is transferred through the nip between the blanket cylinder 34 and the impression cylinder 36.

The inking roller arrangement 52 illustrated in FIG. 3 and FIG. 4 is exemplary for use in combination with lithographic ink printing plates P. It is understood that a dampening system 58 having a dampening fluid reservoir DF is coupled to the inking roller train 52 (FIG. 4), but is not required for waterless or flexographic printing.

The plate cylinder 32 of printing unit 28 is equipped with a waterless printing plate PW. Waterless printing plates are also referred to as dry planographic printing plates and are disclosed in the following U.S. Pat. Nos. 3,910,187; Re. 30,670; 4,086,093; and 4,853,313. Suitable waterless printing plates can be obtained from Toray Industries, Inc. of Tokyo, Japan. A dampening system is not used for waterless printing, and waterless (oil-based) printing ink is used. The waterless printing plate PW has image areas and non-image areas which are oleophilic/hydrophilic and oleophobic/hydrophobic, respectively. The waterless printing plate PW is engraved or etched, with the image areas being recessed with respect to the non-image areas. The image area of the waterless printing plate PW is rolled-up with the flexographic or aqueous printing ink which is transferred by the applicator roller 66. Both aqueous and oil-based inks and coatings are repelled from the non-image areas, and are retained in the image areas. The printing ink or coating is then transferred from the image areas to an ink or coating receptive blanket B and is printed or coated onto a substrate S.

Figure 5:
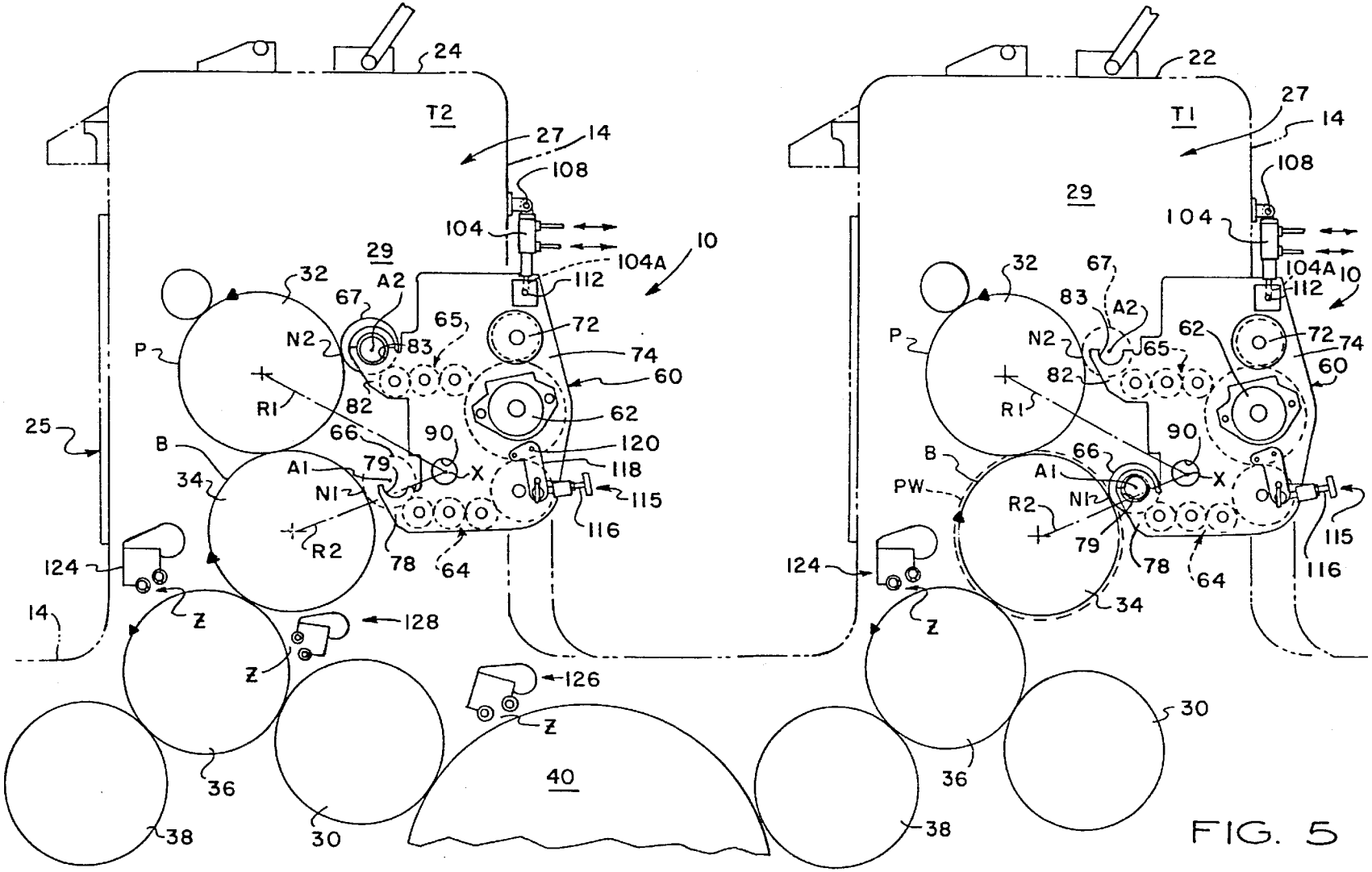
FIG. 5 is a simplified side elevational view showing the single head, dual cradle inking/coating apparatus in the operative position for spot or overall inking or coating on the blanket of the first printing unit, and showing the dual cradle inking/coating apparatus in the operative position for spot or overall inking or coating on the printing plate of the second printing unit.

For some printing jobs, a flexographic plate PF or a waterless printing plate PW is mounted over a resilient packing such as the blanket B on the blanket cylinder 34, for example as indicated by phantom lines in printing unit 22 of FIG. 5. All advantage of this alternative embodiment is that the waterless plate PW or the flexographic plate PF are resiliently supported over the blanket cylinder by the underlying blanket B or other resilient packing. The radial deflection and give of the resilient blanket B provides uniform, positive engagement between the applicator roller 66 and a flexographic plate or waterless plate.

In that arrangement, a plate is not mounted on the plate cylinder 32; instead, a waterless plate PW is mounted on the blanket cylinder, and the inked image on the waterless printing plate is not offset but is instead transferred directly from the waterless printing plate PW to the substrate S. The water component of flexographic ink on the freshly printed sheet is evaporated by high velocity, hot air dryers and high volume heat and moisture extractors so that the freshly printed aqueous or flexographic ink is dried before the substrate is printed on them next printing unit.

Figure 9:
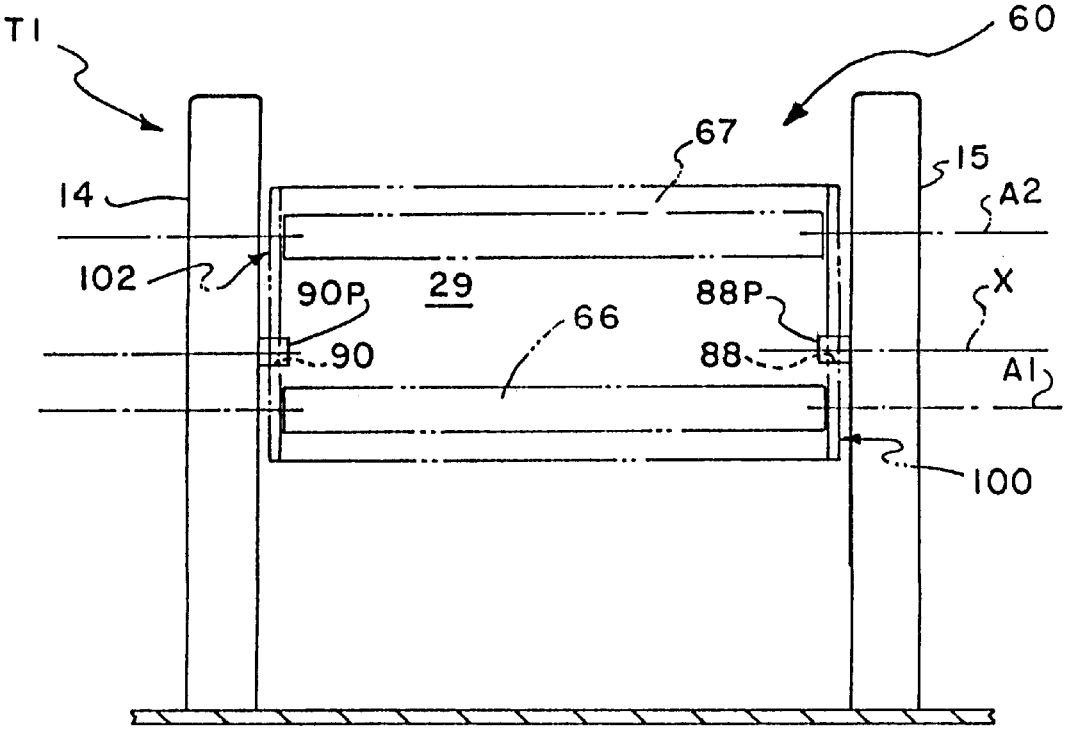
FIG. 9 is a simplified elevational view of a printing unit which illustrates pivotal coupling of the inking/coating apparatus on the printing unit side frame members.
Figure 10:
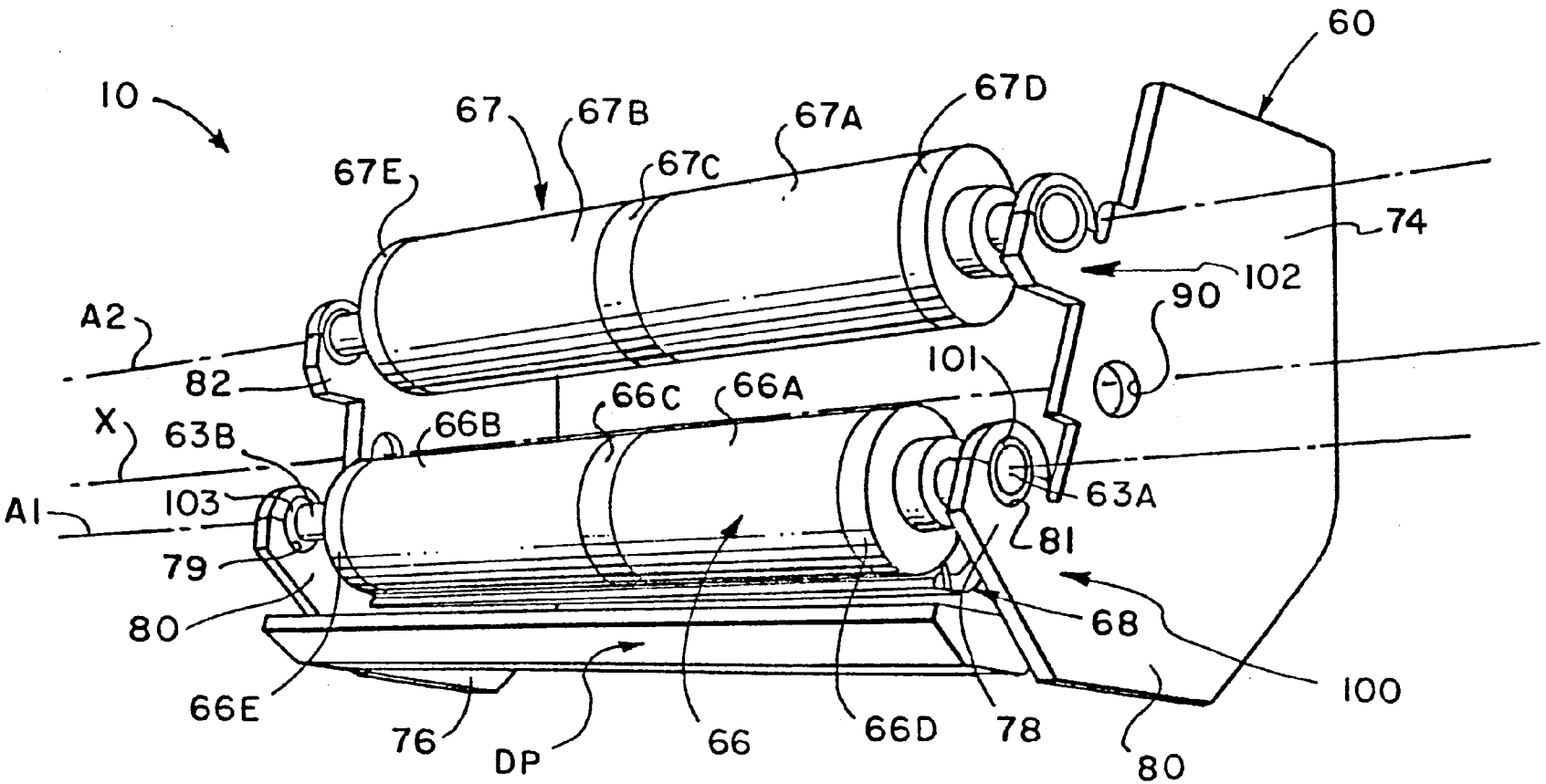
FIG. 10 is a view similar to FIG. 2 in which a pair of split applicator rollers are mounted in the upper cradle and lower cradle, respectively.

Referring now to FIG. 2, FIG. 3 and FIG. 9, this inking/coating apparatus 10 is pivotally mounted on the side frames 14, 15 for rotation about an axis X. The inking/coating apparatus 10 includes a frame 60, a hydraulic motor 62, a lower gear train 64, an upper gear train 65, an applicator roller 66, a sealed doctor blade assembly 68 (FIG. 6), and a drip pan DP, all mounted on the frame 60. The external peripheral surface of the applicator roller 66 is wetted by contact with liquid coating material or ink contained in a reservoir 70.

The hydraulic motor 62 drives the applicator roller 66 synchronously with the plate cylinder 32 and the blanket cylinder 34 in response to an RPM control signal from the press drive (not illustrated) and a feedback signal developed by a tachometer 72. While a hydraulic drive motor is preferred, other drive means such as an electric drive motor or an equivalent can be used.

When using waterless printing plate systems, the temperature of the waterless printing ink and of the waterless printing plate must be closely controlled for good image reproduction. For example, for waterless offset printing with TORAY waterless printing plates PW, it is absolutely necessary to control the waterless printing plate surface and waterless ink temperature to a very narrow range, for example 24° C. (75° F.) to 27° C. (80° F.).

Figure 7:
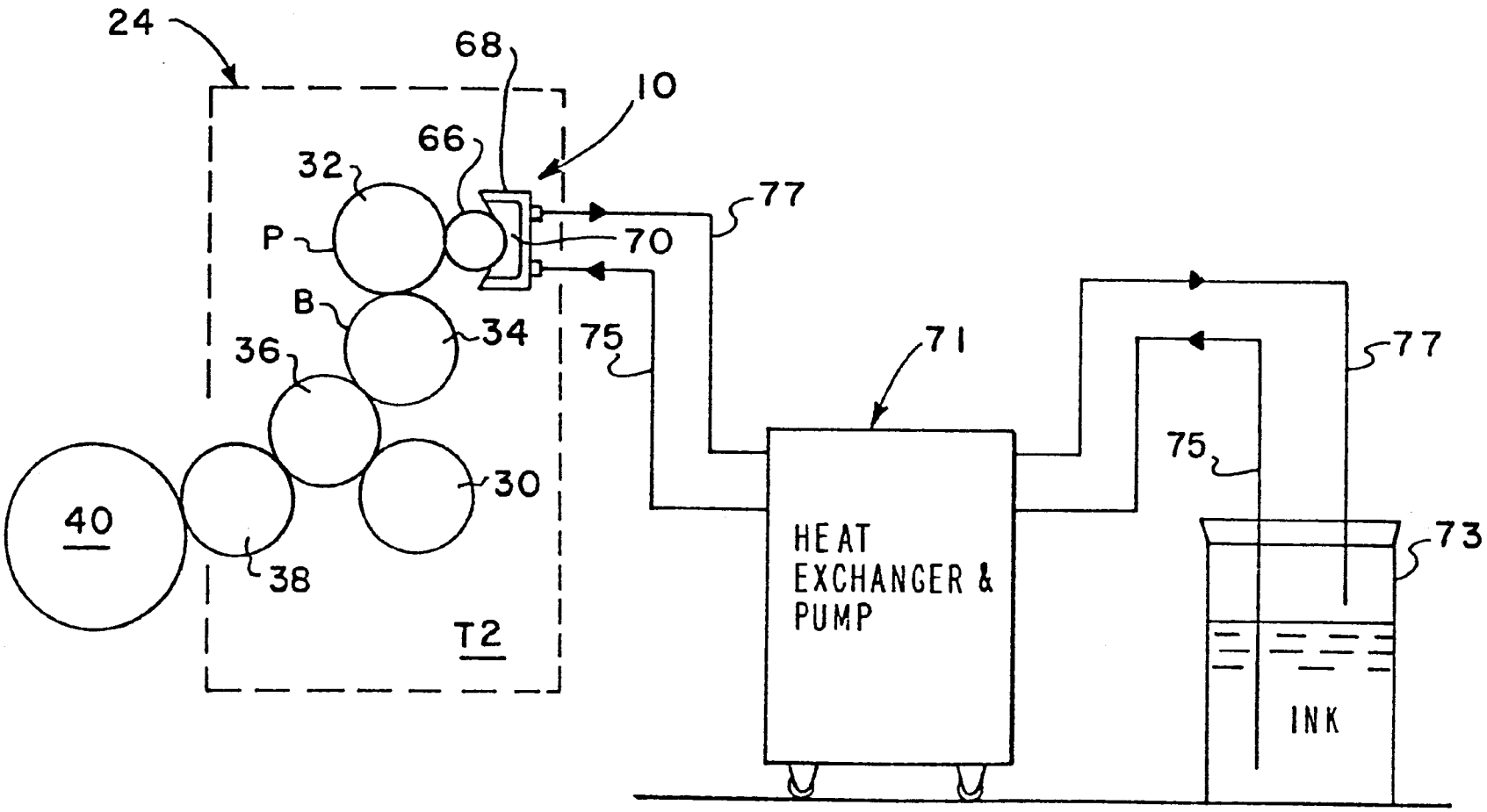
FIG. 7 is a schematic view showing a heat exchanger and pump assembly connected to the single head, dual cradle inking/coating apparatus for circulating temperature controlled ink or coating material to the inking/coating apparatus.

Referring to FIG. 7, the reservoir 70 is supplied with ink or coating which is temperature controlled by a heat exchanger 71. The temperature controlled ink or coating material is circulated by a positive displacement pump, for example a peristaltic pump, through the reservoir 70 and heat exchanger 71 from a source 73 through a supply conduit 75 and a return conduit 77. The heat exchanger 71 cools or heats the ink or coatings material and maintains the ink or coating and the printing plate within the desired narrow temperature range.

According to one aspect of the present invention, aqueous/flexographic ink or coating material is supplied to the applicator roller 66, which transfers the aqueous/flexographic inkor coating material to the printing plate (FIG. 7), which may be a waterless printing plate or a flexographic printing plate. When the inking/coating apparatus is used for applying aqueous/flexographic ink or coating material to a waterless printing plate PW, the inking roller train 52 is not required, and is retracted away from the printing plate. Because the viscosity of aqueous/flexographic printing ink or coating material varies with temperature, it is necessary to heat or cool the aqueous/flexographic printing ink or coating material to compensate for ambient temperature variations to maintain the ink viscosity in a preferred operating range.

For example, the temperature of the printing press can vary from around 60° F. (15° C.) in the morning, to around 85° F. (29° C.) or more in the afternoon. The viscosity of aqueous/flexographic printing ink or coating material can be marginally high when the ambient temperature of the press is near 60° F. (15° C.), and the viscosity can be marginally low when the ambient temperature of the press exceeds 85° F. (29° C.). Consequently, it is desirable to control the temperature of the aqueous/flexographic printing ink or coating material so that it will maintain the surface temperature of waterless printing plates within the specified temperature range. Moreover, the ink/coating material temperature should be controlled to maintain the tack of the aqueous/flexographic printing ink or coating material within a desired range when the ink or coating material is being used in connection with flexographic printing processes.

The applicator roller 66 is preferably an anilox fluid metering roller which transfers measured amounts of printing ink or coating material to a plate or blanket. The surface of an anilox roller is engraved with an array of closely spaced, shallow depressions referred as "cells". Ink or coating from the reservoir 70 flows into the cells as the anilox roller turns through the reservoir. The transfer surface of the anilox roller is "doctored" (wiped or scraped) by dual doctor blades 68A, 68B to remove excess ink or coating material. The ink or coating metered by the anilox roller is that contained within the cells. The dual doctor blades 68A, 68B also seal the supply reservoir 70.

The anilox applicator roller 66 is cylindrical and may be constructed in various diameters and lengths, containing cells of various sizes and shapes. The volumetric capacity of an anilox roller is determined by cell size, shape and number of cells per unit area. Depending upon the intended application, the cell pattern may be fine (many small cells per unit area) or coarse (fewer large cells per unit area).

By supplying the ink or coating material through the inking/coating apparatus 10, more ink or coating material can be applied to the sheet S as compared with the inking roller train of a lithographic printing unit. Moreover, color intensity is stronger and more brilliant because the aqueous or flexographic ink or coating material is applied at a much heavier film thickness or weight than can be applied by the lithographic process, and the aqueous or flexographic colors are not diluted by dampening solution.

Preferably, the sealed doctor blade assembly 68 is constructed as described in U.S. Pat. No. 5,176,077 to Howard W. DeMoore, co-inventor and assignee, which is incorporated herein by reference. An advantage of using a sealed reservoir is that fast drying ink or coating material can be used. Fast drying ink or coating material can be used in an open fountain 53 (see FIG. 8); however, open air exposure causes the water and solvents in the fast-drying ink or coating material to evaporate faster, thus causing the ink or coating material to dry prematurely and change viscosity. Moreover, an open fountain emits unwanted odors into the press room. When the sealed doctor blade assembly is utilized, the pump (FIG. 7) which circulates ink or coating material to the doctor blade head is preferably a peristaltic pump, which does not inject air into the feeder lines which supply the ink or coating reservoir 70 and helps to prevent the formation of air bubbles and foam within the ink or coating material.

An inking/coating apparatus 10 having an alternative applicator roller arrangement is illustrated in FIGS. 10–13. In this arrangement, the engraved metering surface of the anilox applicator rollers 66, 67 are partitioned by smooth seal surfaces 66C which separates a first engraved peripheral surface portion 66A from a second engraved peripheral surface portion 66B. Likewise, smooth seal surfaces 66D, 66E are formed on the opposite end portions of the applicator roller 66 for engaging end seals 134, 136 (FIG. 12) of the doctor blade reservoir. The upper applicator roller 67 has engraved anilox metering surfaces 67A and 67B which are separated by a smooth seal band 67C.

Figure 12:
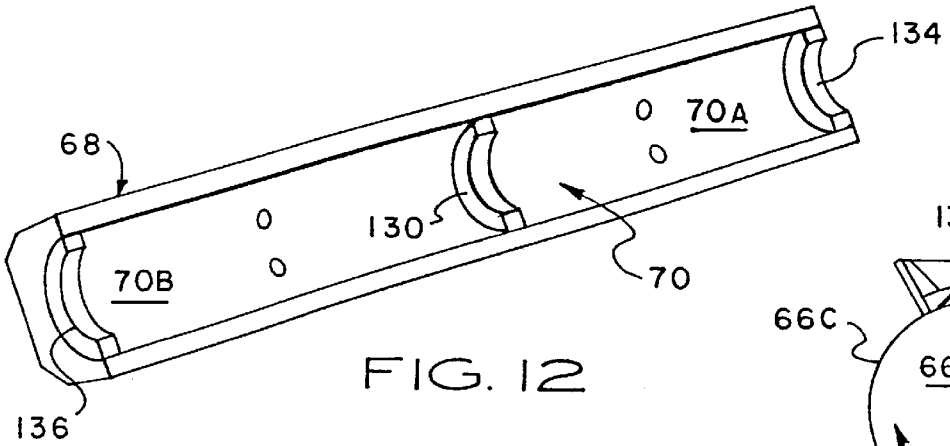
FIG. 12 is a perspective view of a doctor blade reservoir which is centrally partitioned by a seal element.
Figure 13:
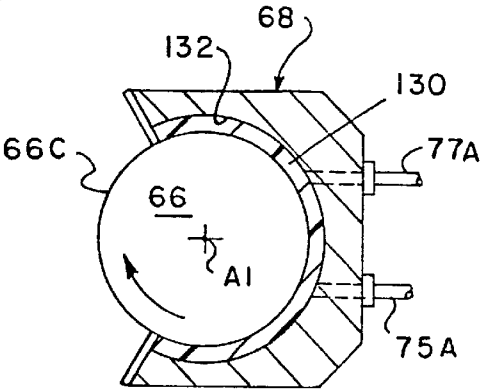
FIG. 13 is a sectional view showing sealing engagement of the split applicator roller against the partition seal element of FIG. 12.

Referring now to FIG. 12 and FIG. 13, the reservoir 70 of the doctor blade head 68 is partitioned by a curved seal element 130 to form two separate chambers 70A, 70B. The seal element 130 is secured to the doctor blade head within an annular groove 132. The seal element 130 is preferably made of polyurethane foam or other durable, resilient foam material. The seal element 130 is engaged by the seal band 66, thus forming a rotary seal which blocks the leakage of ink or coating material from one reservoir chamber into the other reservoir chamber. Moreover, the seal band provides an unprinted or uncoated area which separates the printed or coated areas from each other, which is needed for work and turn printing jobs or other printing jobs which print two or more separate images onto the same substrate.

Another advantage of the split applicator roller embodiment is that it enables two or more flexographic inks or coating materials to be printed simultaneously within the same lithographic printing unit. That is, the reservoir chambers 70A, 70B of the upper doctor blade assembly can be supplied with gold ink and silver ink, for example, while the reservoir chambers 70A, 70B of the lower doctor blade assembly can be supplied with inks of two additional colors, for example opaque white ink and blue ink. This permits the opaque white ink to be overprinted with the gold ink, and the blue ink to be overprinted with the silver ink on the same printing unit on any lithographic press.

Moreover, a catalyst can be used in the upper doctor blade reservoir and a reactive ink or coating material can be used in the lower doctor blade reservoir. This can provide various effects, for example improved chemical resistance and higher gloss levels.

The split applicator roller sections 67A, 67B in the upper cradle position can be used for applying two separate inks or coating materials simultaneously, for example flexographic, aqueous and ultra-violet curable inks or coating materials, to separate surface areas of the plate, while the lower applicator roller sections 66A, 66B can apply an initiator layer and a micro-encapsulated layer simultaneously to separate blanket surface areas. Optionally, the metering surface portions 66A, 66B can be provided with different cell metering capacities for providing different printing effects which are being printed simultaneously. For example, the screen line count on one half-section of an anilox applicator roller is preferably in the range of 200–600 lines per inch (79–236 lines per cm) for half-tone images, and the screen line count of the other half-section is preferably in thee range of 100–300 lines per inch (39–118 lines per cm) for overall coverage, high weight applications such as opaque white. This split arrangement in combination with dual applicator rollers is particularly advantageous when used in connection with "work and turn" printing jobs.

Figure 6:
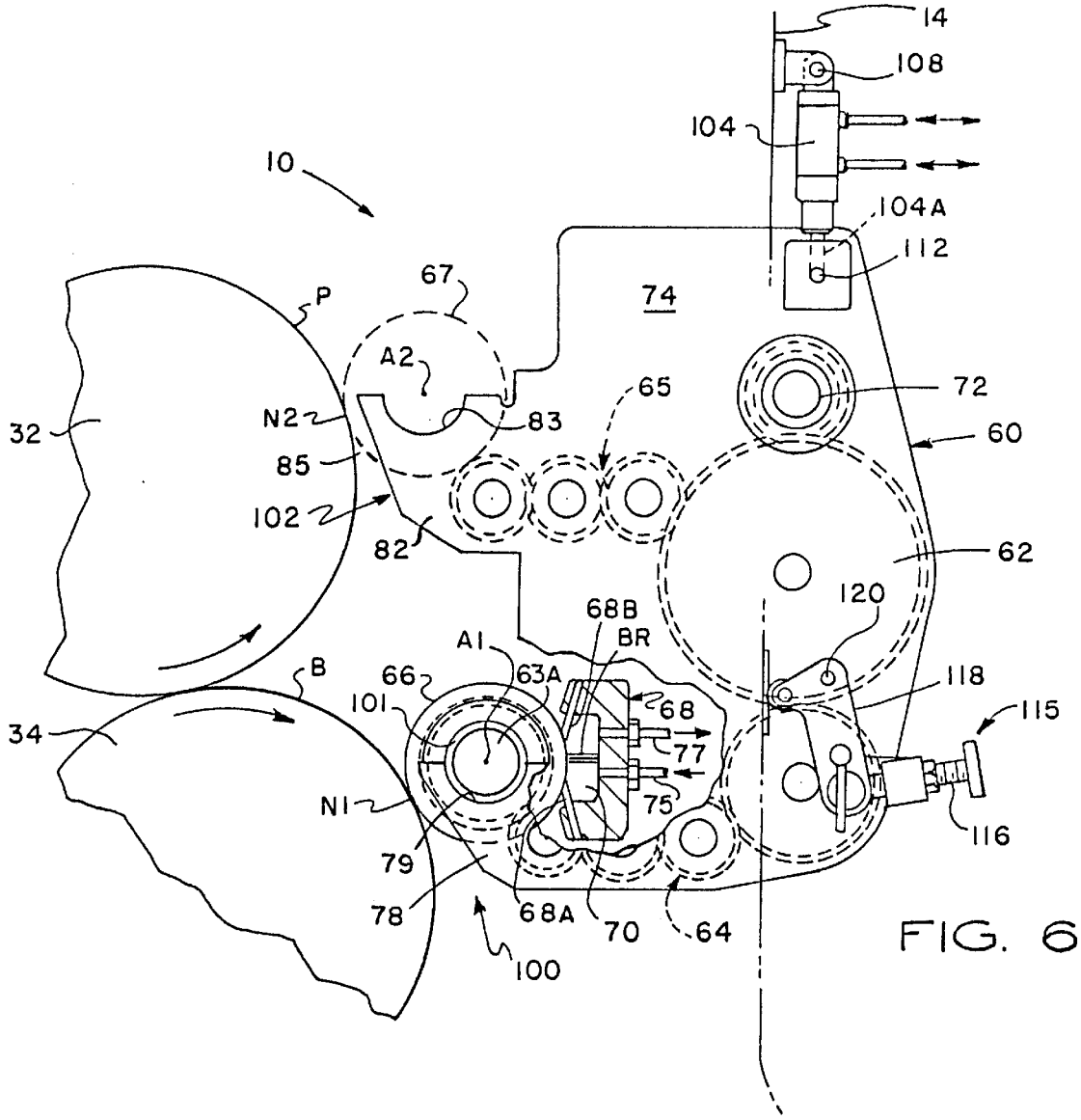
FIG. 6 is a simplified side elevational view of the single head, dual cradle inking/coating apparatus of FIG. 4 and FIG. 5, partially broken away, showing the single head, dual cradle inking/coating apparatus in the operative coating position and having a sealed doctor blade reservoir assembly for spot or overall coating on the blanket.
Figure 16:
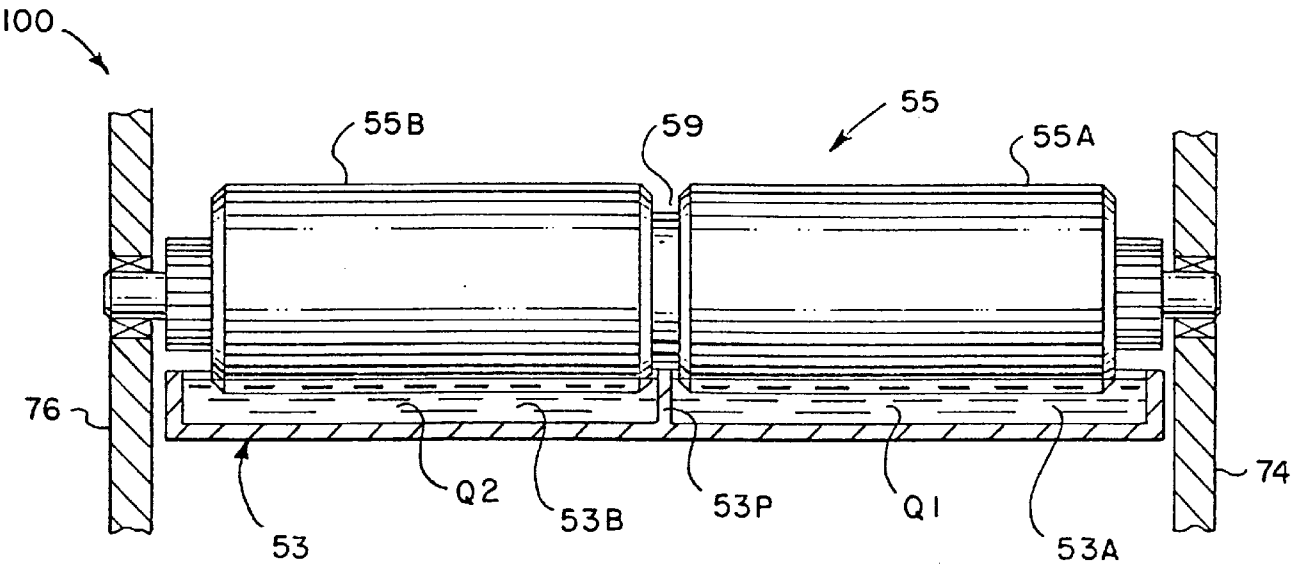
FIG. 16 is a side elevational view, partly in section, of a pan roller having separate transfer surfaces mounted on a split fountain pan.

Referring again to FIG. 8, instead of using the sealed doctor blade reservoir assembly 68 as shown in FIG. 6, an open fountain assembly 69 is provided by the fountain pan 53 which contains a volume of liquid ink Q or coating material. The liquid ink or coating material is transferred to the applicator roller 66 by a pan roller 55 which turns in contact with ink Q or coating material in the fountain pan. If a split applicator roller is used, the pan roller 55 is also split, and the pan is divided into two pan sections 53A, 53B by a separator plate 53P, as shown in. FIG. 16.

In the alternative embodiment of FIG. 16, the pan, roller 55 is divided into two pan roller sections 55A, 55B by a centrally located, annular groove 59. The separator plate 53P is received within and centrally aligned with the groove 59, but does not touch the adjoining roller faces. By this arrangement, two or more inks or coating materials Q1, Q2 are contained within the open pan sections 55A, 55B for transfer by the split pan roller sections 53A, 53B, respectively. This permits two or more flexographic inks or coating materials to be transferred to two separate image areas on the plate or on the blanket of the same printing unit. This arrangement is particularly advantageous for work and turn printing jobs or other printing jobs which print two or more separate images onto the same substrate.

The frame 60 of the inking/coating apparatus 10 includes side support members 74, 76 which support the applicator roller 66, gear train 64, gear train 65, doctor blade assembly 68 and the drive motor 62. The applicator roller 66 is mounted on stub shafts 63A, 63B which are supported at opposite ends on a lower cradle assembly 100 formed by a pair of side support members 78, 80 which have sockets 79, 81 and retainer caps 101, 103. The stub shafts are received in roller bearings 105, 107 which permit free rotation of the applicator roller 66 about its longitudinal axis A1 (axis A2 in the upper cradle). The retainer caps 101, 103 hold the stub shafts 63A, 63B and bearings 105, 107 in the sockets 79, 81 and hold the applicator roller 66 in parallel alignment with the pivot axis X.

The side support members 74, 76 also have an upper cradle assembly 102 formed by a pair of side support members 82, 84 which are vertically spaced with respect to the lower side plates 78, 80. Each cradle 100, 102 has a pair of sockets 79, 81 and 83, 85, respectively, for holding an applicator roller 66, 67 for spot coating or inking engagement with the printing plate P on the plate cylinder 32 (FIG. 4) or with a printing plate P or a blanket B on the blanket cylinder 34.

Preferably, the applicator roller 67 (FIG. 8, FIG. 9) the upper cradle (plate) position is an anilox roller having a resilient transfer surface. In the dual cradle arrangement a shown in FIG. 2, the press operator can quickly change from blanket inking/coating to plate inking/coating within minutes, since it is only necessary to release, remove and reposition or replace the applicator roller 66.

The capability to simultaneously print in the flexographic mode, the aqueous mode, the waterless mode, or the lithographic mode on different printing units of the same lithographic press and to print or coat from either the plate position or the blanket position on any one of the printing units is referred to herein as the LITHOFLEX™ printing process or system. LITHOFLEX™ is a trademark of Printing Research, Inc. of Dallas, Tex., U.S.A., exclusive licensee of the present invention.

Figure 14:
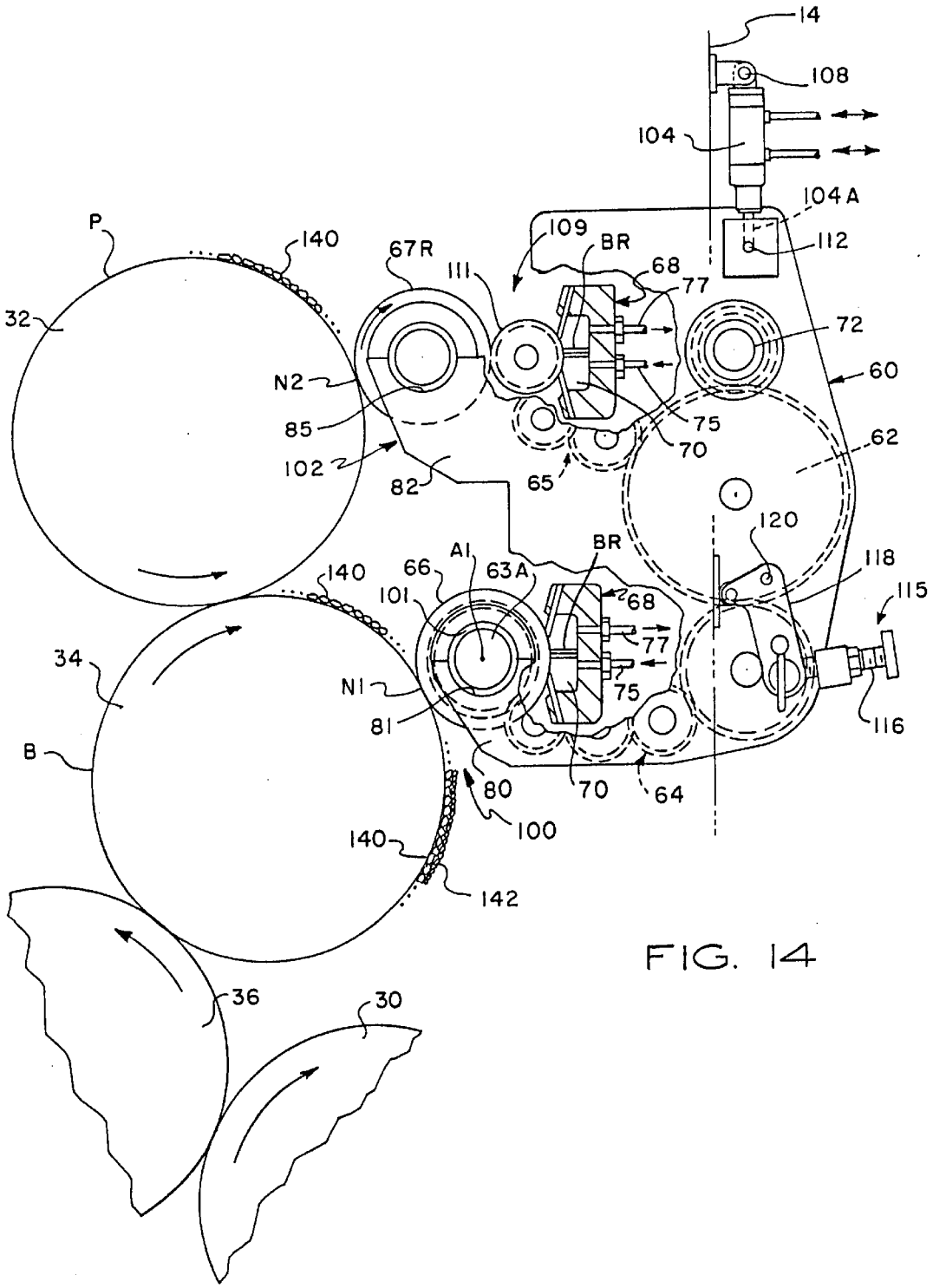
FIG. 14 is a view similar to FIG. 8 which illustrates an alternative inking/coating embodiment.

Referring now to FIG. 14, an inking/coating apparatus 10 having an inking/coating assembly 109 of an alternative design is installed in the upper cradle position for applying ink and/or coating material to a plate P on the plate cylinder 32. According to this alternative embodiment, an applicator roller 67R having a resilient transfer surface is coupled to an anilox fluid metering roller which transfers measured amounts of printing ink or coating material to the plate P. The anilox roller 111 has a transfer surface constructed of metal, ceramic or composite material which is engraved with cells. The resilient applicator roller 67R is interposed in transfer engagement with the plate P and the metering surface of the anilox roller 111. The resilient transfer surface of the applicator roller 67R provides uniform, positive engagement with the plate.

Figure 17:
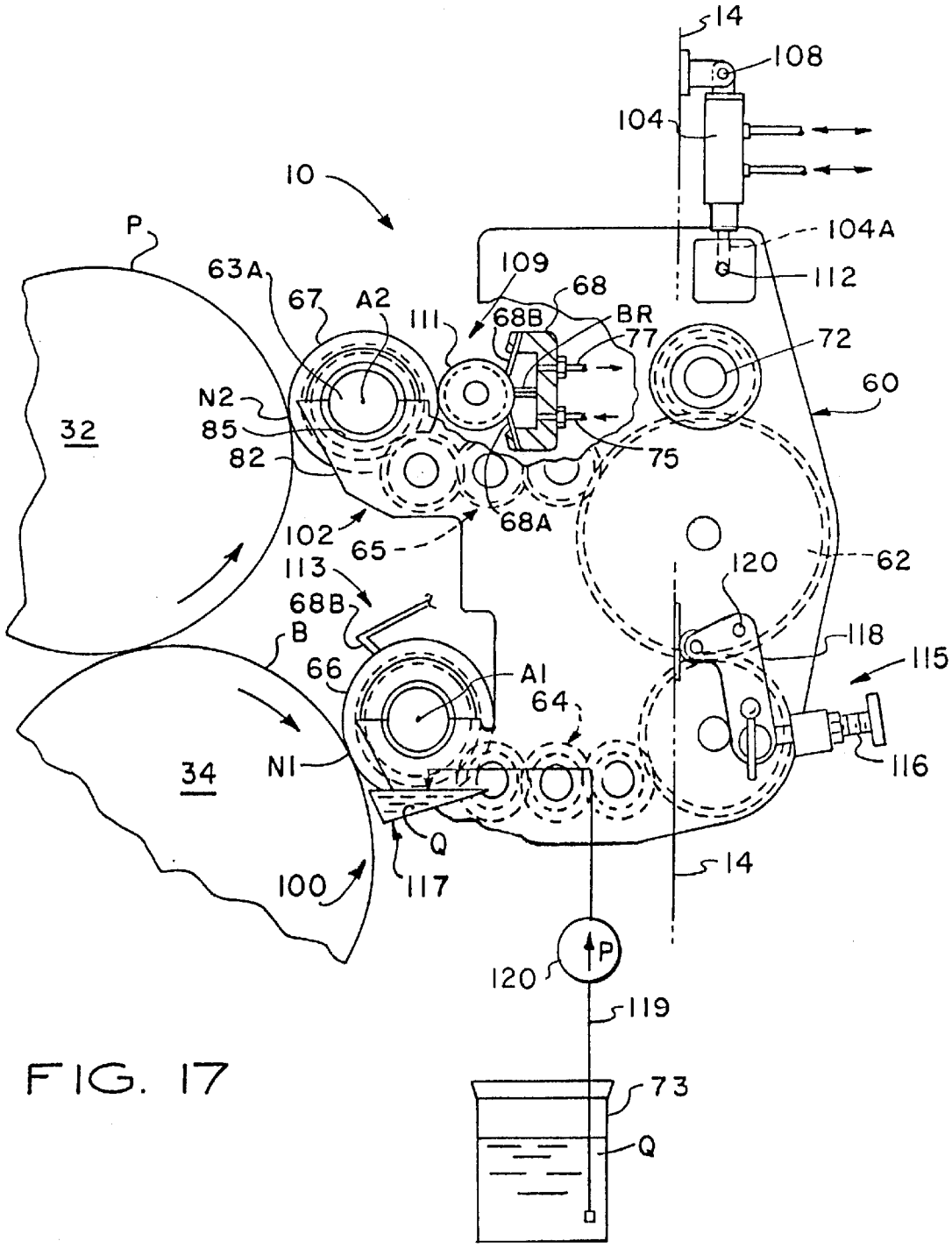
FIG. 17 is a simplified side elevational view of the dual cradle inking/coating apparatus, partially broken away, which illustrates an alternative inking/coating head apparatus featuring a single doctor blade assembly, anilox applicator roller mounted on the lower cradle.

Referring now to FIG. 17, an inking/coating apparatus 10 having an alternative inking/coating assembly 113 is installed in the lower cradle assembly 100 for applying flexographic or aqueous ink and/or coating material Q to a plate or blanket mounted on the blanket cylinder 34. Instead of using the sealed, dual doctor blade reservoir assembly 68 as shown in FIG. 6, an open, single doctor blade anilox roller assembly 113 is supplied with liquid ink Q or coating material contained in an open fountain pan 117. The liquid ink or coating material Q is transferred to the engraved transfer surface of the anilox roller 66 as it turns in the fountain pan 117. Excess ink or coating material Q is removed from the engraved transfer surface by a single doctor blade 68B. The liquid ink or coating material Q is pumped from an off-press source, for example the drum 73 shown in FIG. 17, through a supply conduit 119 into the fountain pan 117 by a pump 120.

Figure 11:
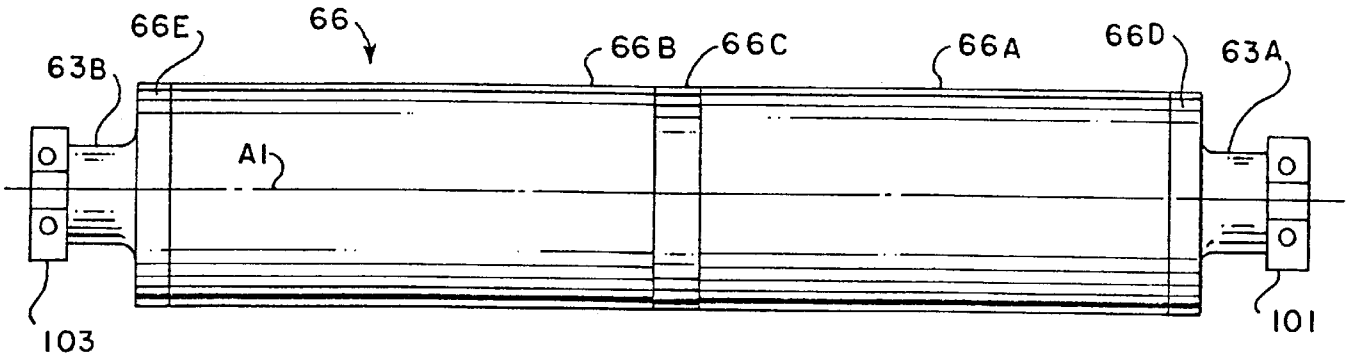
FIG. 11 is a side elevational view of a split applicator roller.
Figure 18:
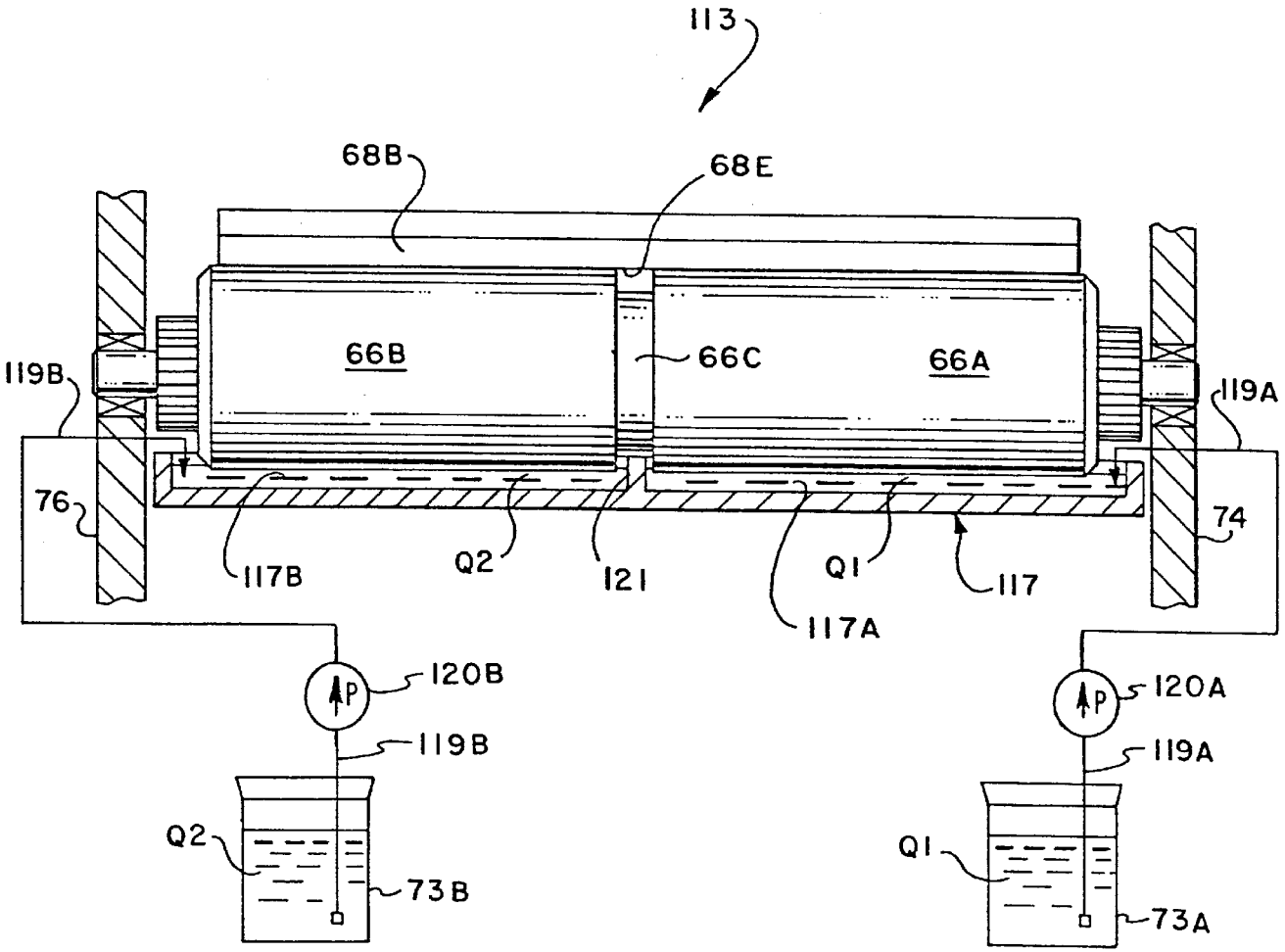
FIG. 18 is a side elevational view, partly in section, of a single doctor blade anilox applicator roller assembly having separate transfer surfaces, and a split fountain pan having separate fountain compartments, with the separate fountain compartments being supplied with different inks or coating materials from separate off-press sources.

For overall inking or coating jobs, the metering transfer surface of the anilox roller 66 extends over its entire peripheral surface. However, for certain printing jobs which print two or more separate images onto the same substrate, fore example work and turn printing jobs, the metering transfer surface of the anilox applicator roller 66 is partitioned by a centrally located, annular undercut groove 66C which separates first and second metering transfer surfaces 66A, 66B as shown in FIG. 11 and FIG. 18.

The single doctor blade 68B has an edge 68E which wipes simultaneously against the split metering transfer surfaces 66A, 66B. In this single blade, split anilox roller embodiment 113, it is necessary to provide dual supply sources, for example drums 73A, 73B, dual supply lines 119A, 119B, and dual pumps 120A, 120B. Moreover, the fountain pan 117 is also split, and the pan 117 is divided into two pan sections 117A, 117B by a separator plate 121, as shown in FIG. 18. The separator plate 121 is centrally aligned with the undercut groove 66C, but does not touch the adjoining roller faces.

Although the single blade, split anilox applicator roller assembly 113 is shown mounted in the lower cradle position (FIG. 17), it should be understood that the single blade, split anilox applicator roller assembly 113 can be mounted and used in the upper cradle position, as well.

According to another aspect of the present invention, the inking/coating apparatus 10 is pivotally coupled on horizontal pivot pins 88P, 90P which allows the single head, dual cradle inking/coating apparatus 10 to be mounted on any lithographic printing unit. Referring to FIG. 9, the horizontal pivot pins 88P, 90P are mounted within the traditional dampener space 29 of the printing unit and are secured to the press side frames 14, 15, respectively. Preferably, the pivot support pins 88P, 90P are secured to the press side frames by a threaded fastener. The pivot support pins are received within circular openings 88, 90 which intersect the side support members 74, 76 of the inking/coating apparatus 10. The horizontal support pins 88P, 90P are disposed in parallel alignment with rotational axis X and with the plate cylinder and blanket cylinder, and are in longitudinal alignment with each other.

Figure 8:
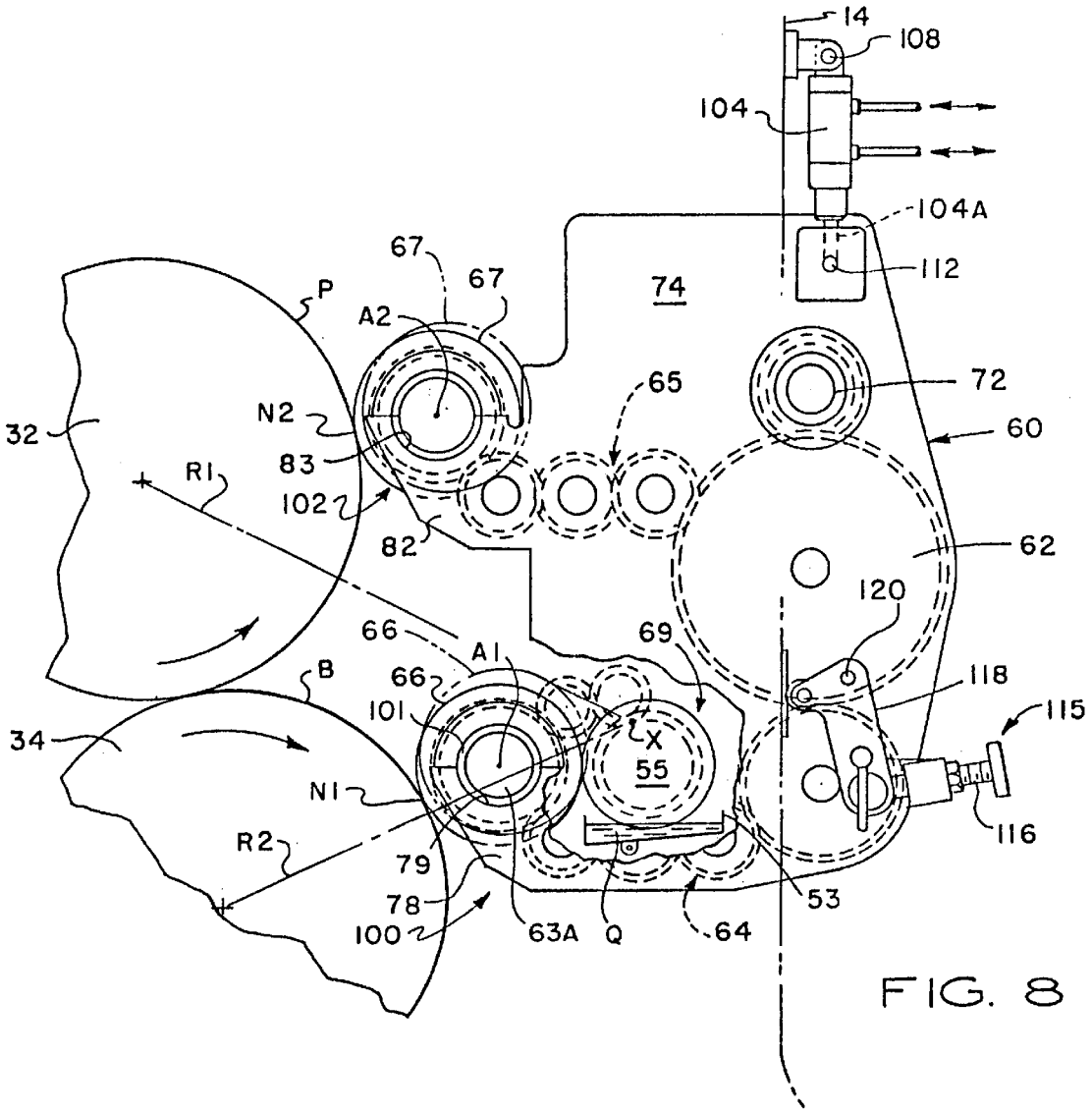
FIG. 8 is a side elevational view, partially broken away, and similar to FIG. 6 which illustrates an alternative coating head arrangement.

Preferably, the pivot pins 88P, 90P are located in the dampener space 29 so that the rotational axes A1, A2 of the applicator rollers 66, 67 are elevated with respect to the nip contact points N1, N2. By that arrangement, the transfer point between the applicator roller 66 and a blanket on the blanket cylinder 34 (as shown in FIG. 8) and the transfer point between the applicator roller 66 and a plate on the plate cylinder 32 (as shown in FIG. 5) are above the radius lines R1, R2 of the plate cylinder and the blanket cylinder, respectively. This permits the inking/coating apparatus 10 to move clockwise to retract the applicator roller 66 to an off-impression position relative to the blanket cylinder in response to a single extension stroke of the power actuator arms 104A, 106A. Similarly, the applicator roller 66 is moved counterclockwise to the on-impression operative position as shown in FIGS. 4, 5, 6 and 8 by a single retraction stroke of the actuator arms 104A, 106A, respectively.

Preferably, the pivot pins are made of steel and the side support members are made of aluminum, with the steel pivot pins and the aluminum collar portion bordering the circular openings 88, 90 forming a low friction journal. By this arrangement, the inking/coating apparatus 10 is freely rotatable clockwise and counterclockwise with respect to the pivot pins 88P, 90P. Typically, the arc length of rotation is approximately 60 mils (about 1.5 mm). Consequently, the inking/coating apparatus 10 is almost totally enclosed within the dampener space 29 of the printing unit in the on-impression position and in the off-impression position.

The cradle assemblies 100 and 102 position the applicator roller 66 in inking/coating alignment with the plate cylinder or blanket cylinder, respectively, when the inking/coating apparatus 10 is extended to the operative (on-impression) position. Moreover, because the inking/coating apparatus 10 is installed within the dampener space 29, it is capable of freely rotating through a small arc while extending and retracting without being obstructed by the press side frames or other parts of the printing press. This makes it possible to install the inking/coating apparatus 10 on any lithographic printing unit. Moreover, because of its internal mounting position within the dampener space 29, the projection of the inking/coating apparatus 10 into the space between printing units is minimal. This assures unrestricted operator access to the printing unit when the applicator head is in the operative (on-impression) and retracted (off-impression) positions.

As shown in FIG. 4 and FIG. 5, movement of the inking/coating apparatus 10 is counterclockwise from the retracted (off-impression) position to the operative (on-impression) position.

Although the dampener side installation is preferred, the inking/coating apparatus 10 can be adapted for operation on the delivery side of the printing unit, with the inking/coating apparatus being movable from a retracted (off-impression) position to an on-impression position for engagement of the applicator roller with either a plate on the plate cylinder or a blanket on the blanket cylinder on the delivery side 25 of the printing unit.

Movement of the inking/coating apparatus 10 to the operative (on-impression) position is produced by power actuators, preferably double acting pneumatic cylinders 104, 106 which have extendable/retractable power transfer arms 104A, 106A, respectively. The first pneumatic cylinder 104 is pivotally coupled to the press frame 14 by a pivot pin 108, and the second pneumatic cylinder 106 is pivotally coupled to the press frame 15 by a pivot pin 110. In response to selective actuation of the pneumatic cylinders 104, 106, the power transfer arms 104A, 106A are extended or retracted. The power transfer arm 104A is pivotally coupled to the side support member 74 by a pivot pin 112. Likewise, the power transfer arm 106A is pivotally coupled to the side support member 76 by a pivot pin 114.

As the power arms extend, the inking/coating apparatus 10 is rotated clockwise on the pivot pins 88P, 90P, thus moving the applicator roller 66 to the off-impression position. As the power arms retract, the inking/coater apparatus 60 is rotated counterclockwise on the pivot pins 88P, 90P, thus moving the applicator roller 66 to the on-impression position. The torque applied by the pneumatic actuators is transmitted to the inking/coating apparatus 10 through the pivot pin 112 and pivot pin 114.

Fine adjustment of the on-impression position of the applicator roller relative to the plate cylinder or the blanket cylinder, and of the pressure of roller engagement, is provided by an adjustable stop assembly 115. The adjustable stop assembly 115 has a threaded bolt 116 which is engagable with a bell crank 118. The bell crank 118 is pivotally coupled to the side support member 74 on a pin 120. One end of the bell crank 118 is engagable by the threaded bolt 116, and a cam roller 122 is mounted for rotation on its opposite end. The striking point of engagement is adjusted by rotation of the bolt 116 so that the applicator roller 66 is properly positioned for inking/coating engagement with the plate P or blanket B and provides the desired amount of inking/coating pressure when the inking/coating assembly 60 is moved to the operative position.

This arrangement permits the in-line inking/coating apparatus to operate effectively without encroaching in the interunit space between any adjacent printing units, and without blocking or obstructing access to the cylinders of the printing units when the inking/coating apparatus is in the extended (off-impression) position or retracted (on-impression) position, Moreover, when the in-line inking/coating apparatus is in the retracted position, the doctor blade reservoir and coating circulation lines can be drained and flushed automatically while the printing press is running as well as when the press has been stopped for change-over from one job to another or from one type of ink or coating to another.

Substrates which are printed or coated with aqueous flexographic printing inks require high velocity hot air for drying. When printing a flexographic ink such as opaque white or metallic gold, it is always necessary to dry the printed substrates between printing units before overprinting them. According to the present invention, the water component on the surface of the freshly printed or coated substrate S is evaporated and dried by high velocity, hot air interunit dryer and high volume heat and moisture extractor units 124, 126 and 128, as shown in FIG. 2, FIG. 4 and FIG. 5. The dryer/extractor units 124, 126 and 128 are oriented to direct high velocity heated air onto the freshly printed/coated substrates as they are transferred by the impression cylinder 36 and the intermediate transfer drum 40 of one printing unit and to another transfer cylinder 30 and to the impression cylinder 36 of the next printing unit. By that arrangement, the freshly printed flexographic ink or coating material is dried before the substrate S is overprinted by the next printing unit.

The high velocity, hot air dryer and high performance heat and moisture extractor units 124, 126 and 128 utilize high velocity air jets which scrub and break-up the moist air layer which clings to the surface of each freshly printed or coated sheet or web. Within each dryer, high velocity air is heated as it flows across a resistance heating element within an air delivery baffle tube. High velocity jets of hot air are discharged through multiple airflow apertures into an exposure zone Z (FIG. 4 and FIG. 5) and onto the freshly printed/coated sheet S as it is transferred by the impression cylinder 36 and transfer drum 40, respectively.

Each dryer assembly includes a pair of air delivered dryer heads 124D, 126D and 128D which are arranged in spaced, side-by-side relationship. The high velocity, hot air dryer and high performance heat and moisture extractor units 124, 126 and 128 are preferably constructed as disclosed in co-pending U.S. patent application Ser. No. 08/132,584, filed Oct. 6, 1993, entitled "High Velocity Hot Air Dryer", to Howard W. DeMoore, co-inventor and assignee of the present invention, and which is incorporated herein by reference, and which is marketed by Printing Research, Inc. of Dallas, Tex., U.S.A., under its trademark SUPER BLUE HV™.

The hot moisture-laden air displaced from the surface of each printed or coated sheet is extracted from the dryer exposure zone Z and exhausted from the printing unit by the high volume extractors 124, 126 and 128. Each extractor head includes an extractor manifold 124E, 126E and 128E coupled to the dryer heads 124D, 126D and 128D and draws the moisture, volatiles, odors and hot air through a longitudinal air gap G between the dryer heads. Best results are obtained when extraction is performed simultaneously with drying. Preferably, an extractor is closely coupled to the exposure zone Z at each dryer location as shown in FIG. 4. Extractor heads 124E, 126E and 128E are mounted on the dryer heads 124D, 126D and 128D, respectively, with the longitudinal extractor air gap G facing directly into the exposure zone Z. According to this arrangement, each printed or coated sheet is dried before it is printed on the next printing unit.

The aqueous water-based inks used in flexographic printing evaporate at a relatively moderate temperature provided by the interunit high velocity hot air dryers/extractors 124, 126 and 128. Sharpness and print quality are substantially improved since the flexographic ink or coating material is dried before it is overprinted on the next printing unit. Since the freshly printed flexographic ink is dry, dot gain is substantially reduced and back-trapping on the blanket of the next printing unit is virtually eliminated. This interunit drying/extracting arrangement makes it possible to print flexographic inks such as metallic ink and opaque white ink on the first printing unit, and then dry-trap and overprint on the second and subsequent printing units.

Moreover, this arrangement permits the first printing unit 22 to be used as a coater in which a flexographic, aqueous or UV-curable coating material is applied to the lowest grade substrate such as recycled paper, cardboard, plastic and the like, to trap and seal-in lint, dust, spray powder and other debris and provide a smoother, more durable printing surface which can be overprinted on the next printing unit.

A first down (primer) aqueous coating layer seals-in the surface of a low grade, rough substrate, for example, re-cycled paper or plastic, and improves overprinted dot definition and provides better ink lay-down while preventing strike-through and show-through. A flexographic UV-curable coating material can then be applied downstream over the primer coating, thus producing higher coating gloss.

Preferably, the applicator roller 66 is constructed of composite carbon fiber material, metal or ceramic coated metal when it is used for applying ink or coating material to the blanket B or other resilient material on the blanket cylinder 34. When the applicator roller 66 is applied to the plate, it is preferably constructed as an anilox roller having a resilient, compressible transfer surface. Suitable resilient roller surface materials include Buna N synthetic rubber and EPDM (terpolymer elastomer).

It has been demonstrated in prototype testing that the inking/coating apparatus 10 can apply a wide range of ink and coating types, including fluorescent (Day Glo), pearlescent, metallics (gold, silver and other metals), glitter, scratch and sniff (micro-encapsulated fragrance), scratch and reveal, luminous, pressure-sensitive adhesives and the like, as well as UV-curable and aqueous coatings.

With the dampener assembly removed from the printing unit, the inking/coating apparatus 10 can easily be installed in the dampener space for selectively applying flexographic inks and/or coatings to a flexographic or waterless printing plate or to the blanket. Moreover, overprinting of the flexographic inks and coatings can be performed on the next printing unit since the flexographic inks and/or coatings are dried by the high velocity, hot air interunit dryer and high volume heat and moisture extractor assembly of the present invention.

The flexographic inks and coatings as used in the present invention contain colored pigments and/or soluble dyes, binders which fix the pigments onto the surface of the substrate, waxes, defoamers, thickeners and solvents. Aqueous printing inks predominantly contain water as a diluent and/or vehicle. The thickeners which are preferred include algonates, starch, cellulose and its derivatives, for example cellulose esters or cellulose ethers and the like. Coloring agents including organic as well as inorganic pigments may be derived from dyes which are insoluble in water and solvents. Suitable binders include acrylates and/or polyvinylchloride.

When metallic inks are printed, the cells of the anilox roller must be appropriately sized to prevent the metal particles from getting stuck within the cells. For example, for metallic gold ink, the anilox roller should have a screen line count in the range of 175–300 lines per inch (68–118 lines per cm). Preferably, in order to keep the anilox roller cells clear, the doctor blade assembly 68 is equipped with a bristle brush BR (FIG. 14 as set forth in U.S. Pat. No. 5,425,809 to Steven M. Person assigned to Howard W. DeMoore, and licensed to Printing Research, Inc. of Dallas, Tex., U.S.A., which is incorporated herein by reference.

The inking/coating apparatus 10 can also apply UV-curable inks and coatings. If UV-curable inks and coatings are utilized, ultra-violet dryers/extractors are installed adjacent to the high velocity hot air dryer/extractor units 124, 126 and 128, respectively.

It will be appreciated that the LITHOFLEX™ printing process described herein makes it possible to selectively operate a printing unit of a press in the lithographic printing mode while simultaneously operating another printing unit of the same press in either the flexographic printing mode or in the waterless printing mode, while also providing the capability to print or coat, separately or simultaneously, from either the plate position or the blanket position. The dual cradle support arrangement of the present invention makes it possible to quickly change over from inking/coating on the blanket cylinder position to inking/coating on the plate cylinder position with minimum press down-time, since it is only necessary to remove and reposition or replace the applicator roller 66 while the inking/coating apparatus 10 is in the retracted position. It is only necessary to remove four cap screws, lift the applicator roller 66 from the cradle, and reposition it in the other cradle. All of this can be accomplished in a few minutes, without removing the inking/coating apparatus 10 from the press.

It is possible to spot coat or overall coat from the plate position or from the blanket position with flexographic inks or coatings on one printing unit and then spot coat or overall coat with UV-curable inks or coatings from the plate position or from the blanket position on another printing unit during the same press run. Moreover, the press operator can spot or overall coat from the plate for one job, and then spot and/or overall coat from the blanket on the next job.

The positioning of the applicator roller relative to the plate or blanket is repeatable to a predetermined preset operative position. Consequently, only minor printing unit modifications or alterations may be required for the LITHOFLEX™ process. Although automatic extension and retraction have been described in connection with the exemplary embodiment, extension to the operative (on-impression) position and retraction to a non-operative (off-impression) position can be carried out manually, if desired. In the manual embodiment, it is necessary to latch the inking/coating apparatus 10 to the press side frames 14, 15 in the operative (on-impression) position, and to mechanically prop) the inking/coating apparatus in the off-impression (retracted) position.

Referring again to FIG. 8, an applicator roller 66 is mounted on the lower cradle assembly 100 by side support members 78, 80, and a second applicator roller 66 is mounted on the upper cradle assembly 102 by side support members 82, 84. According to this arrangement, the inking/coating apparatus 10 can apply printing ink and/or coating material to a plate on the plate cylinder, while simultaneously applying printing ink and/or coating material to a plate or a blanket on the blanket cylinder of the same printing unit. When the same color ink is used by the upper and lower applicator rollers from the plate position and from the blanket position simultaneously on the same printing unit, a "double bump" or double inking films or coating layers are applied to the substrate S during a single pass of the substrate through the printing unit. The tack of the two inks or coating materials must be compatible for good transfer during the double bump. Moreover, the inking/coating apparatus 10 can be used for supplying ink or coating material to the blanket cylinder of a rotary offset web press, or to the blanket of a dedicated coating unit.

According to conventional bronzing techniques, a metallic (bronze) powder is applied off-line to previously printed substrate which produces a grainy, textured finish or appearance. The on-line application of bronze material by conventional flexographic or lithographic printing will only produce a smooth, continuous appearance. However, a grainy, textured finish is preferred for highest quality printing which, prior to the present invention, could only be produced by off-line methods.

Figure 15:
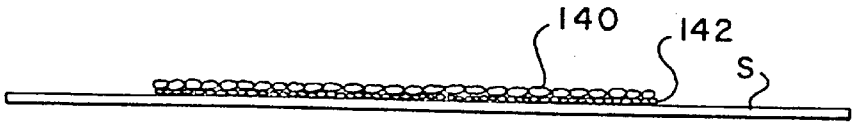
FIG. 15 is a simplified side elevational view of a substrate which has a bronzed-like finish which is applied by simultaneous operation of the dual applicator roller embodiment of FIG. 14.

Referring now to FIG. 14 and FIG. 15, metallic ink or coating material is applied on-line to the substrate S by simultaneous operation of the upper and lower applicator rollers 67R, 66 to produce an uneven surface finish having a bronze-like textured or grainy appearance. According to the simulated bronzing method of the present invention, the flexographic bronze ink is applied simultaneously to the plate and to the blanket by the dual cradle inking/coating apparatus 10 as shown in FIG. 14. A resilient applicator roller 67R is mounted in the upper cradle 102, and an anilox applicator roller 66 is mounted on the lower cradle 100. The rollers are supplied from separate doctor blade reservoirs 70. The doctor blade reservoir 70 in the upper cradle position supplies bronze ink or coating material having relatively coarse, metallic particles 140 dispersed in aqueous or flexographic ink. The coarse particle ink or coating material is applied to the plate P by the resilient applicator roller 67R in the upper cradle position 102. At the same time, flexographic and/or bronze ink or coating material having relatively fine, metallic particles 142 is transferred to the blanket B by the anilox roller 66 which is mounted on the lower cradle 100.

The metering surfaces of the upper and lower applicator rollers have different cell sizes and volumetric capacities which accommodate the coarse and fine metallic particles. For example, the anilox roller Ill mounted in the upper cradle position 102 which transfers the coarse metallic particles 140 preferably has a screen line count in the range of 100–300 lines per inch (39–118 lines per cm), and the metering surface of the anilox roller 66 mounted on the lower cradle 100 which transfers the relatively fine metallic particles 142 preferably has a screen line count in the range of 200–600 lines per inch (79–236 lines per cm).

After transfer from the plate to the blanket, the fine metallic particles 142 form a layer over the coarse metallic particles 140. As both bronze layers are offset onto the substrate S, the layer of fine metallic particles 142 is printed onto the substrate S with the top layer of coarse metallic particles 140 providing a textured, grainy appearance. The fine metallic particles 142 cover the substrate which would otherwise be visible in the gaps between the coarse metallic particles 140. The combination of the coarse particle layer over the fine particle layer thus provides a textured, bronzed-like finish and appearance.

Particulate materials other than metal can be used for producing a textured finish. For example, coarse and fine particles of metallized plastic (glitter), mica particles (pearlescent) and the like, can be substituted for the metallic particles for producing unlimited surface variations, appearances and effects. All of the particulate material, including the metallic particles, are preferably in solid, flat platelet form, and have a size dimension suitable for application by an anilox applicator roller. Other particulate or granular material, for example stone grit having irregular form and size, can be used to good advantage.

Solid metal particles in platelet form, which are good reflectors of light, are preferred for producing the bronzed-like appearance and effect. However, various textured finishes, which could have light-reflective properties, can be produced by using granular materials such as stone grit. Most commonly used metals include copper, zinc and aluminum. Other ductile metals can be used, if desired. Moreover, the coarse and fine particles need not be made of the same particulate material. Various effects and textured appearances can be produced by utilizing diverse particulate materials for the coarse particles and the fine particles, respectively. Further, either fine or coarse particle ink or coating material can be printed from the upper cradle position, and either fine or coarse particle ink or coating material can be printed from the lower cradle position, depending on the special or surface finish that is desired.

It will be appreciated that the last printing unit 28 can be configured for additional inking/coating capabilities which include lithographic, waterless, aqueous and flexographic processes. Various substrate surface effects (for example double bump or triple bump inking/coating or bronzing) can be performed on the last printing unit. For triple bump inking/coating, the last printing unit 28 is equipped with an auxiliary in-line inking or coating apparatus 97 as shown in FIG. 3 and FIG. 4. The in-line inking or coating apparatus 97 allows the application of yet another film of ink or a protective or decorative layer of coating material over any freshly printed or coated surface effects or special treatments, thereby producing a triple bump. The triple bump is achieved by applying a third film of ink or layer of coating material over the freshly printed or coated double bump simultaneously while the substrate is on the impression cylinder of the last printing unit.

When the in-line inking/coating apparatus 97 is installed, it is necessary to remove the SUPER BLUE® flexible covering from the delivery cylinder 42, and it is also necessary to modify or convert the delivery cylinder 42 for inking/coating service by mounting a plate or blanket B on the delivery cylinder 42, as shown in FIG. 3 and FIG. 4. Packing material is placed under the plate or blanket B, thereby packing the plate or blanket B at the correct packed-to-print radial clearance so that ink or coating material will be printed or coated onto the freshly, printed substrate S as it transfers through the nip between the plate or blanket B on the converted delivery cylinder 42 and the last impression cylinder 36. According to this arrangement, a freshly printed or coated substrate is overprinted or overcoated with a third film or layer of ink or coating material simultaneously while a second film or layer of ink or coating material is being over-printed or over-coated on the last impression cylinder 36.

The auxiliary inking/coating apparatus 97 and the converted or modified delivery cylinder 42 are mounted on the delivery drive shaft 43. The inking/coating apparatus 97 include an applicator roller, preferably an anilox applicator roller 97A, for supplying ink or coating material to a plate or blanket B on the modified or converted delivery cylinder 42. The in-line inking/coating apparatus 97 and the modified or converted delivery cylinder 42 are preferably constructed as described in U.S. Pat. No. 5,176,077 to Howard W. DeMoore (co-inventor and assignee), which is hereby incorporated by reference. The in-line inking/coating apparatus 97 is manufactured and sold by Printing Research, Inc. of Dallas, Tex., U.S.A., under its trademark SUPER BLUE EZ COATER™.

After the delivery cylinder 42 has been modified or converted for inking/coating service, and because of the reduced nip clearance imposed by the plate or blanket B, the modified delivery cylinder 42 can no longer perform its original function of guiding and transferring the freshly printed or coated substrate. Instead, the modified or converted delivery cylinder 42 functions as a part of the inking/coating apparatus 97 by printing or coating a third down film of ink or layer of coating material onto the freshly printed or coated substrate as it is simultaneously printed or coated on the last impression cylinder 36. Moreover, the mutual tack between the second down ink film or coating layer and the third down ink film or coating layer causes the overprinted or overcoated substrate to cling to the plate or blanket, thus opposing or resisting separation of the substrate from the plate or blanket.

To remedy this problem, a vacuum-assisted transfer apparatus 99 is mounted adjacent the modified or converted delivery cylinder 42 as shown in FIG. 3 and FIG. 4. Another purpose of the vacuum-assisted transfer apparatus 99 is to separate the freshly overprinted or overcoated triple bump substrate from the plate or blanket B as the substrate transfers through the nip. The vacuum-assisted transfer apparatus 99) produces a pressure differential across the freshly overprinted or overcoated substrate as it transfers through the nip, thus producing a separation force onto the substrate and providing a clean separation from the plate or blanket B.

The vacuum-assisted transfer apparatus 99 is preferably constructed as described in U.S. Pat. Nos. 5,113,255; 5,127,329; 5,205,217; 5,228,391; 5,243,909; and 5,419,254, all to Howard W. DeMoore, co-inventor, which are incorporated herein by reference. The vacuum-assisted transfer apparatus 99 is manufactured and sold by Printing Research, Inc. of Dallas, Tex., U.S.A. under its trademark BACVAC™.

Although the present invention and its advantages have been described in detail, it should be understood that various changes, substitutions and alterations can be made herein without departing from the spirit and scope of the present invention as defined by the appended claims.

What is claimed is:

1. In a rotary offset printing press of the type having multiple printing towers in succession comprising spaced first and second press side frame members comprising printing units operatively supporting a plate cylinder, a blanket cylinder and an impression cylinder for rotation in operable combination wherein each printing unit has a delivery side and a dampener side having a dampener or a space for a dampening assembly between the first and second press side frame members, and an interunit press operator space between successive printing units, the improvement comprising:

a printing apparatus mounted in the space for a dampening assembly on the dampener side of a printing unit, the printing apparatus comprising a frame movably coupled to the press side frame members in the dampener space for movement between an on-impression operative position and an off-impression retracted position;

the printing apparatus frame having an upper cradle and drive adapted for supporting a first applicator roller in position for impression with the plate cylinder when the printing apparatus is moved to the on-impression operative position; and at least one first applicator roller being drivingly supported in said printing apparatus.

2. The apparatus of claim 1 wherein said at least one first applicator roller is an anilox roller having a resilient transfer surface.

3. The apparatus of claim 1 wherein the drive includes an adjustable speed motor mounted on the frame.

4. The apparatus of claim 3 further including a power actuator having a power transfer arm connected to the frame whereby movement of the power transfer arm moves the frame to one of the on-impression or off-impression positions.

5. The apparatus of claim 4 wherein the frame is pivotably coupled to the side frames of the press whereby it is pivoted between the on-impression and the off-impression positions in response to operation of the power actuator.

6. The apparatus of claim 5 wherein the pivoting arc is less than about 2 mm.

7. The apparatus of claim 5 wherein an adjustable stop assembly connected to the frame provides a fine adjustment for the on-impression position of the printing apparatus.

8. The apparatus of claim 7 wherein the adjustable stop assembly comprises a bell crank plate pivotally coupled to the frame, a first end portion in contact with the press and a second end portion in contact with an adjustment device.

9. The apparatus of claim 5 wherein the frame comprises a pair of spaced apart side support members configured for installation substantially within the dampener space of the printing unit with only minimal projection into the interunit operator space between successive printing towers.

10. The apparatus of claim 8 wherein the side support members are pivotally coupled to the side frames of the press by means of pivot pins mount ed on an axis which parallels the plate cylinder.

11. The apparatus of claim 1 wherein the frame comprises a pair of spaced apart side support member configured for installation substantially within the dampener space of a printing unit with only minimal projection into the interunit operator space between successive printing towers.

12. The apparatus of claim 11 wherein the side support members are pivotally coupled to the side frames of the press by means of pivot pins mounted on an axis which parallels the plate cylinder.

13. The apparatus of claim 12 wherein the printing apparatus is mounted in the dampener space of a printing unit having a waterless printing plate on the plate cylinder, the printing apparatus having a means for applying printing liquid to said first applicator roller carried by the frame whereby printing liquid can be applied to the waterless printing plate and then transferred to a substrate.

14. The apparatus of claim 13 wherein the means for applying printing liquid comprises the combination of a sealed reservoir doctor blade assembly and an anilox roller.

15. The apparatus of claim 13 wherein the first applicator roller is an anilox roller with a resilient transfer surface.

16. The apparatus of claim 13 wherein the means for applying printing liquid comprises the combination of a fountain for printing liquid in liquid transfer contact with an anilox roller.

17. The apparatus of claim 16 wherein the anilox roller is an anilox roller with a resilient transfer surface.

18. In a rotary offset printing press of the type having multiple printing towers in succession comprising spaced first and second press side frame members comprising printing units operatively supporting a plate cylinder, a blanket cylinder and an impression cylinder for rotation in operable combination to print a substrate passing between the blanket cylinder and impression cylinder wherein each printing unit has a delivery side and a dampener side having a dampener or a space for a dampening assembly between the first and second press side frame members, and an interunit press operator space between successive printing units, the improvement comprising:

a printing apparatus mounted in the space for a dampening assembly on the dampener side of a printing unit, the printing apparatus comprising a frame movably coupled to the press side frame members in the dampener space for movement between an on-impression operative position and an off-impression retracted position;

the frame comprising a pair of spaced apart side support members configured for installation substantially within said space for a dampening assembly of the printing unit, the frame having an upper cradle and drive adapted for supporting a first applicator roller in position for impression with the plate cylinder and a lower cradle and drive for supporting a second applicator roller in position for impression with the blanket cylinder when the printing apparatus is moved to the on-impression operative position; and at least one first or second applicator roller drivingly supported in said printing apparatus and a means for applying printing liquid thereto which is carried by the frame of the printing unit.

19. A printing press as defined in claim 18 including:

a high velocity hot air dryer and vapor extraction unit mounted on the printing unit for discharging heated air onto a freshly printed substrate before the freshly printed substrate is transferred to a successive printing unit.

20. A printing press as defined in claim 19 wherein:

the dryer unit is mounted adjacent the impression cylinder for discharging heated air onto the freshly printed substrate while the substrate is still in contact with the impression cylinder.

21. A printing press as defined in claim 18, comprising:

a substrate transfer apparatus disposed in an interunit position following said printing unit and coupled in sheet transfer relation with the impression cylinder;

an interunit high velocity hot air dryer and vapor extraction unit disposed adjacent the substrate transfer apparatus for discharging heated air onto a freshly printed substrate after it has been transferred from said printing unit and while it is in contact with the transfer cylinder.

22. A printing press as defined in claim 18 comprising:

a high velocity hot air dryer mounted on the printing unit for discharging heated air onto a freshly printed substrate; and, an extractor coupled to the dryer for extracting hot air and moisture vapors form an exposure zone between the dryer and the freshly printed substrate.

23. A printing press as defined in claim 18 wherein the at least one first or second applicator roller comprises:

a roller having a resilient transfer surface.

24. A printing press as defined in claim 18, the printing press including a successive printing unit, the successive printing unit having an impression cylinder, further including:

a transfer drum coupled in sheet transfer relation with the impression cylinder of a prior printing unit and in substrate transfer relation with the impression cylinder of the successive printing unit;

a first dryer mounted adjacent the impression cylinder of the prior printing unit for discharging heated air onto a freshly printed substrate while the substrate is in contact with the impression cylinder of the prior printing unit;

a second dryer mounted adjacent the transfer drum for discharging heated air onto a freshly printed substrate after it has been transferred from the impression cylinder of the prior printing unit and while it is in contact with the transfer drum; and, a third dryer disposed adjacent the impression cylinder of the successive printing unit for discharging heated air onto a freshly printed substrate after it has been transferred form the transfer drum and while it is in contact with the impression cylinder of the successive printing unit.

25. A printing press as defined in claim 18 wherein:

a plate cylinder having a waterless printing plate mounted thereon, the waterless printing plate having non-image surface areas which are oleophobic and hydrophobic, and having image surface areas which are oleophilic and hydrophilic;

a blanket cylinder having a printing liquid receptive blanket disposed in printing liquid transfer engagement with the waterless printing plate for receiving printing liquid from the image surface areas of the waterless printing plate.

26. A printing press as defined in claim 25 comprising:

a supply container for containing a volume of heat sensitive printing liquid;

circulation means coupled between the supply container and the printing apparatus for inducing the flow of heat sensitive printing liquid form the supply container to the printing apparatus and for returning the printing liquid from the printing apparatus to the supply container; and heat exchanger means coupled to the circulation means for maintaining the temperature of the heat sensitive printing liquid within a predetermined temperature range.

27. A printing press as defined in claim 25 wherein the means for applying printing liquid comprises:

a fountain pan for containing a volume of printing liquid material;

the at least a first or second applicator roller having a metering surface; and, a pan roller mounted for rotation in a fountain pan and coupled to said applicator roller for transferring printing liquid material from the fountain pan to the applicator roller.

28. A printing press as defined in claim 25 wherein the means for applying printing liquid comprises:

a first reservoir or fountain means mounted on the upper cradle means for containing printing liquid material;

said first applicator roller mounted for rotation on the upper cradle and disposed for rolling contact with printing liquid material in the first reservoir or fountain means, the first applicator roller being engagable with the waterless plate on the plate cylinder.

29. A printing press as defined in claim 18, wherein the printing apparatus is pivotally mounted on the printing unit in a position in which the nip contact point between the at least one first or second applicator roller at impression with the respective plate or blanket cylinder is offset with respect to a radius line projecting through the center of the plate cylinder or blanket cylinder to the axis of rotation of the printing apparatus.

30. A printing press as defined in claim 18, wherein:

said at least one first or second applicator roller has first and second fluid metering transfer surfaces and a seal band surface disposed between and separating the first and second fluid metering transfer surfaces;

the means for applying printing liquid comprises reservoir means having a chamber and a partition seal disposed within the chamber, the partition seal dividing the chamber thereby defining a first reservoir chamber region and a second reservoir chamber region; and, the partition seal being disposed in sealing engagement against the seal band of said first or second applicator roller.

31. A printing press as defined in claim 18, characterized in that:

said at least one first or second applicator roller comprise a first applicator roller disposed in the upper cradle and a second applicator roller disposed in the second cradle of the printing apparatus;

said first and second applicator rollers have first and second metering transfer surfaces and a seal band surface disposed between and separating the first and second metering transfer surfaces;

the means for applying printing liquid comprises first and second reservoir means in respective printing liquid transfer contact with the first and second applicator rollers, each reservoir means having a chamber and a partition seal disposed within the chamber, the partition seal dividing the chamber thereby defining a first reservoir chamber region and a second reservoir chamber region; and the partition seal bands of the first and second applicator roller are disposed respectively in sealing contact with the partition seal of the respective first and second reservoir means.

32. A printing press as defined in claim 30 wherein a volumetric capacity of the first fluid metering transfer surface is different from a volumetric capacity of the second fluid metering surface.

33. A printing press as defined in claim 18, wherein:

said means for applying printing liquid comprises a fountain pan having first and second pan sections for containing first and second printing liquids, respectively;

said at least one first or second applicator roller having first and second transfer surfaces and an annular groove separating said first and second transfer surfaces; and a pan roller having first and second transfer surfaces mounted for rotation in the first and second pan sections, respectively, for separately transferring printing liquid from the first and second pan sections to the first and second transfer surfaces of said at least one first or second applicator roller.

34. In a rotary offset printing press of the type having multiple printing towers in succession comprising spaced first and second press side frame members comprising printing units operatively supporting a plate cylinder, a blanket cylinder and an impression cylinder for rotation in operable combination wherein each printing unit has a delivery side and a dampener side having a dampener or a space for a dampening assembly between the first and second press side frame members, and an interunit press operator space between successive printing units, the improvement comprising:

a printing apparatus mounted in the space for a dampening assembly on the dampener side of a printing unit, the printing apparatus comprising a frame movably coupled to the press side frame members in the dampener space for movement between an on-impression operative position and an off-impression retracted position;

the printing apparatus frame having a lower cradle and drive for supporting a second applicator roller in position for impression with the blanket cylinder when the printing apparatus is moved to the on-impression operative position; and at least one second applicator roller being drivingly supported in said printing apparatus.

35. The apparatus of claim 34 wherein said at least one second applicator roller is an anilox roller having a resilient transfer surface.

36. The apparatus of claim 34 wherein the drive includes an adjustable speed motor mounted on the frame.

37. The apparatus of claim 36 further including a power actuator having a power transfer arm connected to the frame whereby movement of the power transfer arm moves the frame to one of the on-impression or off-impression positions.

38. The apparatus of claim 37 wherein the frame is pivotably coupled to the side frames of the press whereby it is pivoted between the on-impression and the off-impression positions in response to operation of the power actuator.

39. The apparatus of claim 38 wherein the pivoting arc is less than about 2 mm.

40. The apparatus of claim 38 wherein an adjustable stop assembly connected to the frame provides a fine adjustment for the on-impression position of the printing apparatus.

41. The apparatus of claim 40 wherein the adjustable stop assembly comprises a bell crank plate pivotally coupled to the frame, a first end portion in contact with the press and a second end portion in contact with an adjustment device.

42. The apparatus of claim 38 wherein the frame comprises a pair of spaced apart side support members configured for installation substantially within the dampener space of the printing unit with only minimal projection into the interunit operator space between successive printing towers.

43. The apparatus of claim 42 wherein the side support members are pivotally coupled to the side frames of the press by means of pivot pins mounted on an axis which parallels the plate cylinder.

44. The apparatus of claim 34 wherein the frame comprises a pair of spaced apart side support member configured for installation substantially within the dampener space of a printing unit to allow operator access into the interunit operator space between the printing apparatus and a preceding printing unit in the press.

45. The apparatus of claim 44 wherein the side support members are pivotally coupled to the side frames of the press by means of pivot pins mounted on an axis which parallels the plate cylinder.

46. The apparatus of claim 45 wherein the printing apparatus is mounted in the dampener space of a printing unit having a waterless printing plate on the blanket cylinder, the printing apparatus having a second applicator roller and a means for applying printing liquid to the second applicator roller whereby printing liquid can be applied to the waterless printing plate and then transferred to a substrate.

47. The apparatus of claim 46 wherein the means for applying printing liquid comprises the combination of a sealed reservoir doctor blade assembly and an anilox roller.

48. The apparatus of claim 46 wherein the second applicator roller is an anilox roller with a resilient transfer surface.

49. The apparatus of claim 46 wherein the means for applying printing liquid comprises the combination of a fountain for printing liquid in liquid transfer contact with an anilox roller.

50. The apparatus of claim 49 wherein the anilox roller is an anilox roller with a resilient transfer surface.

* * * * *

UNITED STATES PATENT AND TRADEMARK OFFICE

CERTIFICATE OF CORRECTION

PATENT NO. : 6,116,158
DATED : September 12, 2000
INVENTOR(S) : Howard W. DeMoore, Ronald M. Rendleman, John W. Bird It is certified that error appears in the above-identified patent and that said Letters Patent is hereby corrected as shown below:

Column 20,
Claim 10,
Line 57, delete "8" and insert therefor -- 9 --.
Line 59, delete "mount ed" after pins and insert -- mounted --.

Column 22,
Claim 22,
Line 11, delete "form" after vapors and insert -- from --.

Claim 24,
Line 38, delete "form" after transferred and insert -- from --.

Claim 26,
Line 58, delete "form" after liquid and insert -- from --.

Column 23,
Claim 28,
The entire last paragraph of the claim was omitted. Please add the following after cylinder on line 18:

Line 18: the waterless plate on the plate cylinder[.];

-- a second reservoir or fountain means mounted on the lower cradle for receiving printing liquid material. --

Signed and Sealed this

Twenty-third Day of October, 2001

*Attest:*

Nicholas P. Godici

*Attesting Officer*

NICHOLAS P. GODICI
*Acting Director of the United States Patent and Trademark Office*